United States Patent [19]

Robertson et al.

[11] Patent Number: 4,808,018

[45] Date of Patent: Feb. 28, 1989

[54] MARKING APPARATUS WITH MATRIX DEFINING LOCUS OF MOVEMENT

[75] Inventors: John A. Robertson; David L. Cyphert, both of Chillicothe, Ohio

[73] Assignee: Telesis Controls Corporation, Chillicothe, Ohio

[21] Appl. No.: 66,092

[22] Filed: Jun. 24, 1987

[51] Int. Cl.[4] ..... B41J 3/12; B41J 3/40

[52] U.S. Cl. ..... 400/121; 101/3.1; 400/127; 400/130

[58] Field of Search ..... 400/121, 127–134.3; 101/3 R, 4

[56] References Cited

U.S. PATENT DOCUMENTS

| | | | |
|---|---|---|---|
| 3,941,051 | 3/1976 | Barrus | 400/130 X |
| 4,006,786 | 2/1977 | Speicher | 101/3 R X |
| 4,077,336 | 3/1978 | Talvard | 101/93.05 |
| 4,089,262 | 5/1978 | Sopora | 101/4 |
| 4,264,219 | 4/1981 | Arai | 400/121 |
| 4,438,692 | 3/1984 | Yanadori | 400/131 X |
| 4,557,191 | 12/1985 | Speicher | 400/121 X |
| 4,591,279 | 3/1986 | Speicher | 400/127 X |

*Primary Examiner*—Paul T. Sewell

*Attorney, Agent, or Firm*—Mueller and Smith

[57] ABSTRACT

Apparatus for forming multi-character messages on the surface of solid materials which employs an array of marker pins moved by a carriage in a manner defining an undulating locus of movement. This locus traces the matrix with which character fonts are defined by pixels formed by the marker pins as discrete indentations. The carriage and head containing the marker pin are pivotally driven by a cam to provide vertical movement and by a Geneva mechanism to provide horizontal movement. Pixel positions for the matrices are established by a timing disk and control over the pins is provided employing an interrupt approach. Each marking pin within the head assembly is capable of marking more than one complete character for a given transverse of the head between home and away limits.

22 Claims, 19 Drawing Sheets

+5V
374
372
376
BP RST
TD RST
TOL
GND ST
S1
C1
378
370
RST
SID
SOD
ALDA
READY
INTA
TRAP
INTR
HOLD
SO
S1
RD
WR
IOM
CLK OUT
RST OUT
RST 7.5
RST 6.5
RST 5.5
A15
A14
A13
A12
A11
A10
A9
A8
AD7
AD6
AD5
AD4
AD3
AD2
AD1
AD0
ALE
380
R9
436
508
FROM USART 474
416
450
451
452
456
R10
426
424
414
460
TO FIG.17B
422
410
420
532
510
538
540
530
446
S2
R2
390
514
566
574
630
601
600
599
598
597
596
560
561
569
610
618
648
604
605
613
430
412
434
418
R3
S3
392
394
R4
398
400
FROM AWAY LIMIT
FROM HOME LIMIT
402
R6
OW AIR
404
406
408
R7
R8
R1
382
C2
384
386
389
388
TIMER IN
TIMER OUT
GND
438
440
444
442
432
PR
D
Q
TO FIG.17C

FROM FIG. 17A
+5V
BRCLK VCC
TXD
RXD
DTR
DSR
CTS
DCD
RX READY
TX READY
GND
D7 D6 D5 D4 D3 D2 D1 D0
CE A1 A0
R/W RESET
TXC
RXC
OSC OUT
OSC IN
DIS
G1 G2A G2B C B A GND
Y7 Y6 Y5 Y4 Y3 Y2 Y1 Y0
AD7 AD6 AD5 AD4 AD3 AD2 AD1 AD0
A12 A11 A10 A9 A8 A7 A6 A5 A4 A3 A2 A1 A0
CE OE
WE OE
C3 C4 C5 C6 C7 C8
R11 R12
451 452 450 454 542 546 544 548 550 552 554 516 538 540 446 462 466 468 464 472 470 458 460 430 532 420 410 510 538 540 514 536 534 528 526 524 522 520 518 530 508 506 504 502 500 498 494 492 490 488 486 484 482 480 478 476 474

MARKING APPARATUS WITH MATRIX DEFINING LOCUS OF MOVEMENT

BACKGROUND

As industry has refined and improved production techniques and procedures, requirements have arisen for placing identifying or data related markings upon components of manufactured assemblies. With such marking, the history of the product may be traced throughout the stages of its assembly.

A variety of product marking approaches have been employed in the industry. For example, paper tags carrying bar codes or the like may be adhesively applied to the components in the course of assembly. However, for many applications, these tags will exhibit poor permanence and abrasion resistance characteristics. Ink or paint spraying of codes such as dot matrix codes are unacceptable for employment in rigorous production environments, inasmuch as they will be expunged in the course of many production procedures. Of course, subsequent printing stages in a production process would nullify the above marking approaches.

The provision of a traceable marking upon hard surfaces such as metal traditionally has been provided with marking punches utilizing dies which carry a collection of full form characters. These "full face dies" may be positioned in a wheel or ball form of die carrier which is manipulated to define a necessarily short message as it is dynamically struck into the material to be marked. As is apparent, the necessarily complex materials involved are prone to failure and full faced dies exhibit rapid wear characteristics. Generally, the legibility and abrasion resistance of the resultant marks can be considered to be only fair in quality. Additionally, the marking punch approach is considered a poor performer in marking such surfaces as epoxy coatings and the like.

Laser activated marking systems have been employed, however, the required equipment is of a relatively higher cost and the abrasion resistance and "readability after painting" characteristics of laser formed characters are considered somewhat poor.

Over the recent past, a computer drive dot matrix marking technique has been successfully introduced into the marketplace. Described in U.S. Pat. No. 4,506,999 by Robertson entitled "Program Controlled Pin Matrix Embossing Apparatus", the marking approach employs a series of seven tool steel punches which are uniquely driven using a pneumatic floating impact concept to generate ASCII characters or reverse font characters which are man readable, as well as linear dot codes which are machine readable. Marketed under the trade designation "PINSTAMP" these devices carry the noted tool steel punches or "pins" in a head assembly which is moved relative to the piece being marked at a selected skew angle to indent a dot or pixel defined permanent message or code into a surface of the marked component. The approach enjoys the advantage of providing characters of good legibility as well as permanence. Further, a capability for forming the messages or codes during forward or reverse head movements is realized. The device provides dot matrix characters of good abrasion resistance, good permanence and legibility and is, advantageously, capable of marking upon such surfaces as epoxy coatings. However, inasmuch as the pin retaining head of this apparatus is required to traverse over a distance representing that between the outside punches or pins plus one character width, the application of the device in a production environment wherein items of multi-faceted shape and small size are encountered is somewhat constrained. Preferably, the apparatus is employed where adequate tracking space is available on the product to be marked. Additionally, because there is a relative movement between the marker head and the item being marked, it is necessary to fixture these two parts to assure proper relative movement therebetween. For some production procedures, for example those employing items hanging from chains and the like, this fixturing involves complexity. To meet the continuously broadening marking requirements of industry, an application of the dot matrix stamping approach which can perform in cramped locations at adequate speeds and with minimal fixturing is desirable.

SUMMARY

The present invention is addressed to an apparatus for marking surfaces with indented dot matrix formed characters which enjoys a capability for forming multi-character data within confined regions. Employing steel stamping pins driven using the noted floating impact concept, a control mechanism simultaneously moves the pins in a raster-like locus of travel while stamping occurs. Through the use of this undulatory locus, each of the pins simultaneously stamps to define an entire character or sequence of characters within its assigned stamping region.

In one embodiment, the stamping pins are assembled as a linear array within a stamping head, their mutual spacing being selected with respect to the number of characters assigned to be formed for each pin. While stamping occurs, the stamping head traverses laterally and vertically up and down to define an undulating locus of travel tracing the matrix within which character fonts are defined. Vertical stamping head movement may be provided by a pivotal drive developed from a rotary cam. Corresponding traverse movement takes place at upper and lower traverse limit positions and preferably is developed in an intermittent fashion using a Geneva mechanism such that the matrix defining locus of pin movement is squarewave in shape. Synchronization and control of the actuation of the pneumatically driven stamping pins is carried out using a timing element such as a disk which co-rotates with the cam device to define each possible pixel location within each character defining matrix. Thus, the processor components of the control respond to a data entry character and develop the pixel selection to apply to a given matrix path. The control performs in interrupt fashion with respect to each pixel location of the matrices.

Another feature of the invention is to provide apparatus for marking objects at a surface thereof with dot-like indentations arranged within a predetermined character forming matrix of pixel locations. These pixel locations are of a predetermined number and they are arranged within vertical columns, the columns being spaced apart in lateral increments of predetermined extent. The apparatus includes a head assemblage having a confronting portion movable between first and second terminal positions along a lateral locus of travel and which is simultaneously movable between third and fourth terminal positions substantially transversely with respect to the lateral locus of travel to effect a predetermined undulating locus of travel pattern, the head assemblage having at least one chamber extending interiorly from the confronting portion and a marker pin mounted for reciprocation within the chamber. The marker pin is formed having a drive portion and a shaft portion depending therefrom and is extensible through an opening within the confronting portion. Further the shaft portion has an impact tip which is driveably movable into the surface. A drive arrangement is provided for reciprocally driving the marker pin drive portion in response to control inputs. Additionally, a motor within the apparatus provides a drive output which is employed by a first actuator which is responsive to that motor drive output for effecting intermittent movement of the confronting portion along the lateral locus of travel between the first and second terminal positions, wherein the confronting surface is horizontally shifted to sequential indexing positions representing the matrix vertical columns. A second actuator is responsive to the drive output for effecting movement of the head assemblage confronting portion between the third and fourth terminal positions when the confronting portion is positioned by the first actuator at an indexing position and effecting a stationary dwell of the confronting portion at a vertical terminal position during the horizontal shift movement thereof. A control is included which is responsive to the predetermined locus of travel of the head assemblage between the first and second and third and fourth terminal positions for deriving the control inputs to the drive arrangement during the confronting portion movement between the vertical third and fourth terminal positions and only in correspondence with the pixel locations.

Another feature of the invention provides apparatus for marking solid material objects at a surface thereof in response to data inputs with a sequence of indentation defining characters, each within a pixel defined matrix zone of given width. The apparatus includes a carriage moveable with the matrix having predetermined pixel locations arranged within adjacent vertical columns. respect to the surface between first and second terminal positions along a laterally directed locus of travel and between third and fourth vertical terminal positions substantially transversely with respect to the laterally directed locus of travel to effect an undulating locus of travel pattern within a serial succession of these matrix zones. First and second spaced marker pin assemblies are mounted upon the carriage, each having a respective first and second marker pin mounted for reciprocation within a chamber, each first and second marker pin having a drive portion and a shaft portion depending therefrom and extensible through an opening in the chamber. The shaft portion is formed having an impacting tip drivably movable into the surface within a matrix zone the first and second marker pins being linearly aligned along the laterally directed locus of travel and being mutually spaced apart a distance representing a whole integer times the zone given width. A drive arrangement is provided for reciprocally driving each of the marker pin drive portions in response to control inputs and a motor is included for providing a drive output intermittent movement of the carriage along the lateral locus of travel between the first and second terminal positions, wherein the first and second spaced marker pin assemblies are horizontally shifted to sequential indexing positions corresponding with respectively spaced matrix vertical columns, and for effecting movement of the carriage between the vertical third and fourth positions when the first and second spaced marker pin assemblies are positioned at indexing positions and effecting a stationary dwell of the carriage at a vertical terminal position during the horizontal shift movement. second terminal positions and between the third and fourth terminal control derives the drive control inputs to effect simultaneously controlled character forming driving of the marker pin drive portions within spaced first and second ones of the zones corresponding with respective first and second spaced marker pin assemblies the control inputs effect the sequential formation of more than one character by each of the first and second marker pin assemblies.

Other objects of the invention will, in part, be obvious and will, in part, appear hereinafter. The invention, accordingly, comprises the apparatus and system providing the construction, combination of elements and arrangement of parts which are exemplified in the following detailed disclosure. For a fuller understanding of the nature and objects of the invention, reference should be had to the following detailed description taken in connection with the accompanying drawings.

BRIEF DESCRIPTION OF THE DRAWINGS

FIG. 25 is a side view of an embodiment of the instant invention designed for use in marking upon cylindrical surfaces and the like.

DETAILED DESCRIPTION OF THE INVENTION

The marking system described herein is a compact assemblage which may be hand-held and which functions to apply impact marking to hard surfaces formed, for example, of aluminum, steel, brass, plastics, and the like. An array of stamping pins are employed within a head component of the device which is manipulated in an undulating locus of movement as the pins are actuated such that each stamping pin will apply all of the dot-like or pixels necessary to form complete characters which fall within its assigned stamping zone. With the arrangement, markings may be carried out within highly confined regions of products moving along an assembly line. The initial embodiment of the system illustrated herein is one employing four such stamping pins and is configured to be hand-held or manipulated by a robot. However, it will occur to the reader that a broad variety of configurations including those having variations in the number of stamping pins and other such modifications are available with the concept at hand.

Figure 1:
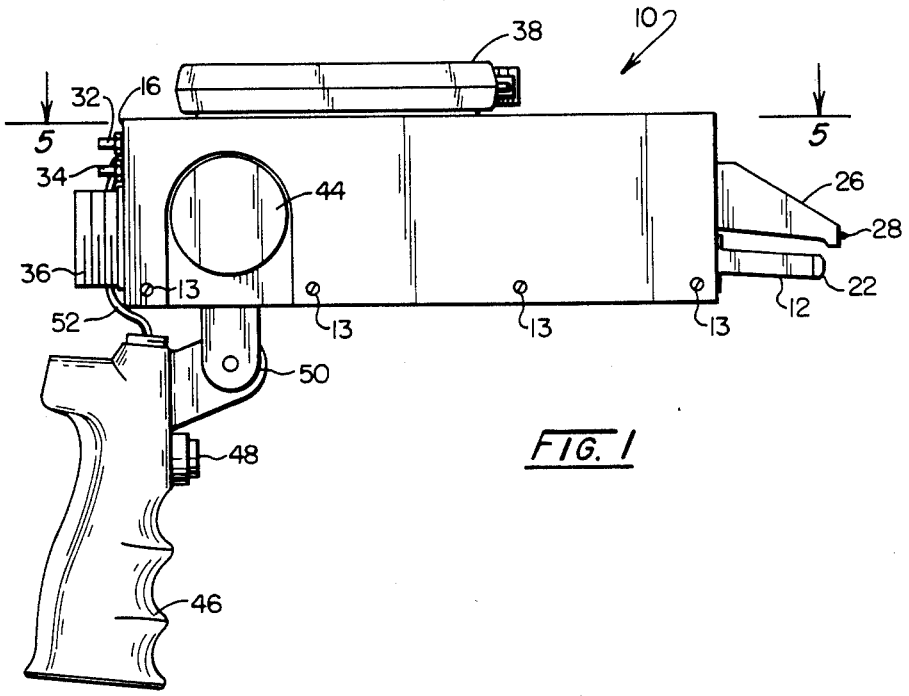
FIG. 1 is a side elevational view of apparatus according to the invention.
Figure 2:
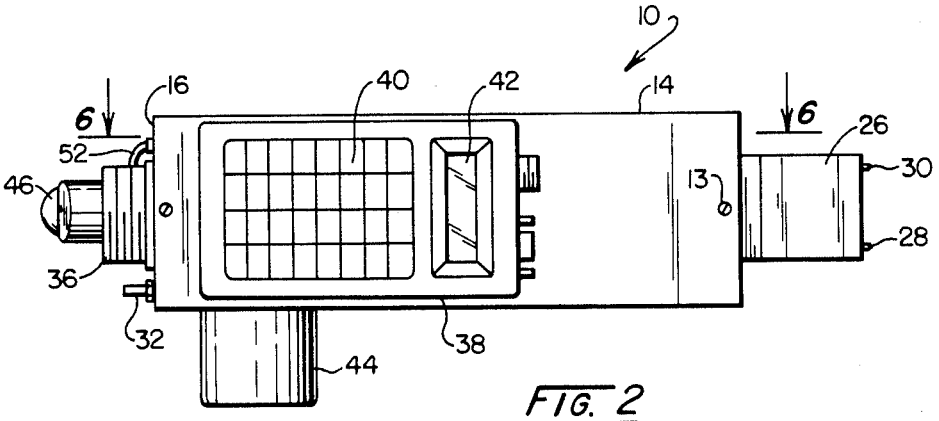
FIG. 2 is a top view of the apparatus shown in FIG. 1.
Figure 3:
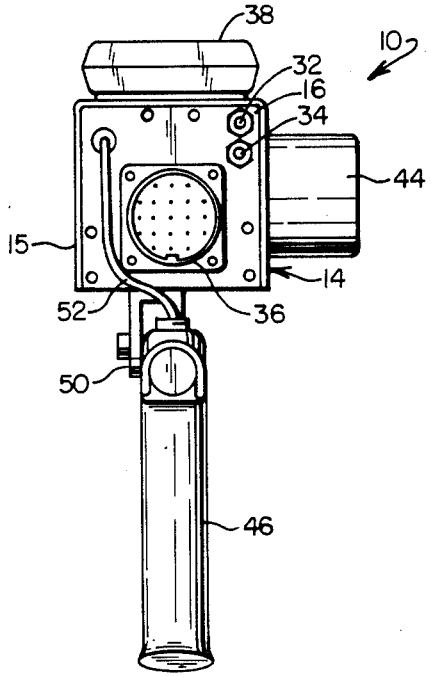
FIG. 3 is a rear view of the apparatus of FIG. 1.
Figure 4:
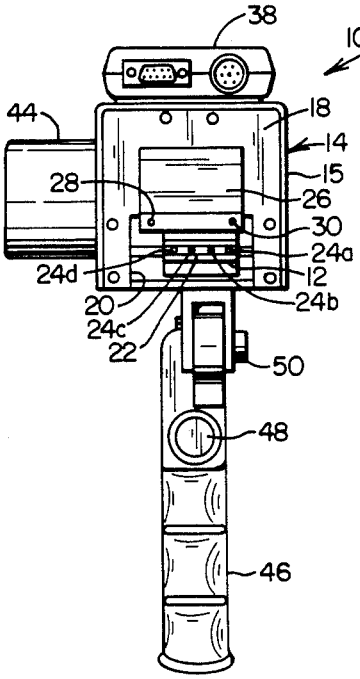
FIG. 4 is a front view of the apparatus of FIG. 1.

Referring to FIGS. 1 and 2, the hand-held embodiment shows a marking apparatus 10 having a stamping pin retaining head 12 extending outwardly from the front portion of a housing 14. Housing 14 is of elongate rectangular shape extending from a rearward plate shown in FIG. 3 at 16 to a forward plate 18 as seen in FIG. 4. These faces are coupled to a framework (not shown) and a U-shaped cover 15 is seen extending between them. Screws 13 retain the cover 15 in position. FIG. 4 reveals that the head 12 is internally mounted within the device 10 and extends through an opening 20 within the forward plate 18 such that the confronting portion 22 (FIG. 1) of head 12 may be positioned somewhat in adjacency with the surface to be marked. Such marking occurs with the selective pneumatic driving of marking pins through four openings in the confronting portion 22 represented at 24*a*–24*d*. Additionally attached to the plate 18 is a simple fixturing or retaining member 26 having contact or securing points 28 and 30 extending outwardly therefrom which are moved into engagement with the surface to be marked to aid in retaining a steady orientation of the device 10. In the latter regard, for example, to provide a 5×7 pixel matrix to develop a character or font, the head 12 is moved both laterally and up and down a relatively short distance while the marking or stamping pins extending from openings 24a-24d are selectively driven into the surface to be marked. Pneumatic input for the driving features is introduced, for example, at 100 p.s.i. to the device 10 by a conduit connection as represented at 34 and return air is provided, for example, at 20 p.s.i. through adjacent conduit connector 32 as represented in FIGS. 1 and 3. The particular treatment of the pneumatic input and return is described, for example, in the earlier referenced U.S. Pat. No. 4,506,999 which is incorporated herein by reference. Corresponding logic input to the apparatus 10 may emanate from a variety of computer sources. For example, a multi-pin connector 36 is provided at rearward plate 16, while a small hand-held computer unit 38 may be associated with the apparatus 10 for in situ insertion of data to be printed via the keyboard as represented at 40 and associated liquid crystal display at 42 (FIG. 2). Motive power for indexing the head 12 is supplied to the apparatus 10 by a d.c. electric motor within a motor housing 44 shown extending from the housing 14. The assemblage may be hand grasped by an operator at a pistol grip 46 carrying an actuator button or switch 48. Grip 46 is adjustably attached to housing 14 by a hand coupling assembly 50 and is in electrical association therewith by an electrical cable 52.

Figure 14:
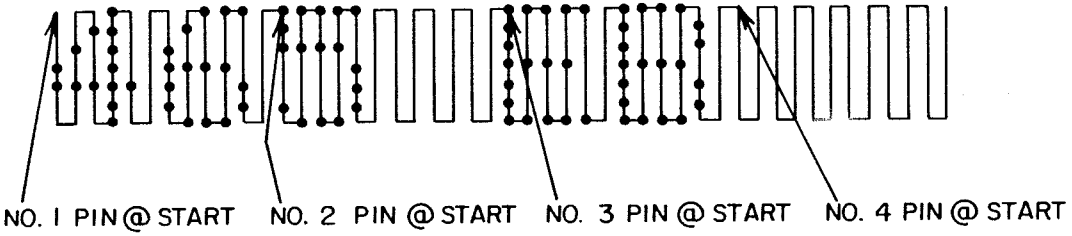
FIG. 14 is a diagram showing a locus of travel which may be followed by the stamping pins of the apparatus of FIG. 1.

The maximum extent of the message desired to be imprinted by the apparatus 10 establishes the criteria for the number of stamping pins employed and their spacing as well as the size of the matrix within which the characters or fonts are developed. For the instant embodiment, four stamping pins are employed and each of these pins creates the pixels in the surface being marked to develop two characters to provide a total of eight characters which, for example, may be 3/16 inch in width. Generally, the spacing of the stamping pins must be a whole integer factor of matrixcharacter size. By comparison, ⅛ inch wide character matrices can be created by a head 12 containing six stamping pins to create a maximum message extent of 18 characters and a total lateral head movement of 3/8 inch. The device 10 can print in either direction of traverse of the head 12, i.e. from "home" to "away" limit positions or the reverse thereof. Additionally, the starting position for the head 12 is a matter of design selection, i.e. whether at the upper or lower position and whether at either lateral terminus. Looking momentarily to FIG. 14, the locus of travel of four pins to define a 5×7 matrix for pixel character definition is revealed. Four pin starting positions are labeled 1–4 representing "home" starting positions. Note that the locus of movement of each pin is one initially vertically downward then laterally then transversely directly upwardly, then laterally and the like to provide matrix path or locus definition wherein each of the four pins can generate three characters in mutually simultaneous fashion.

Figure 5:
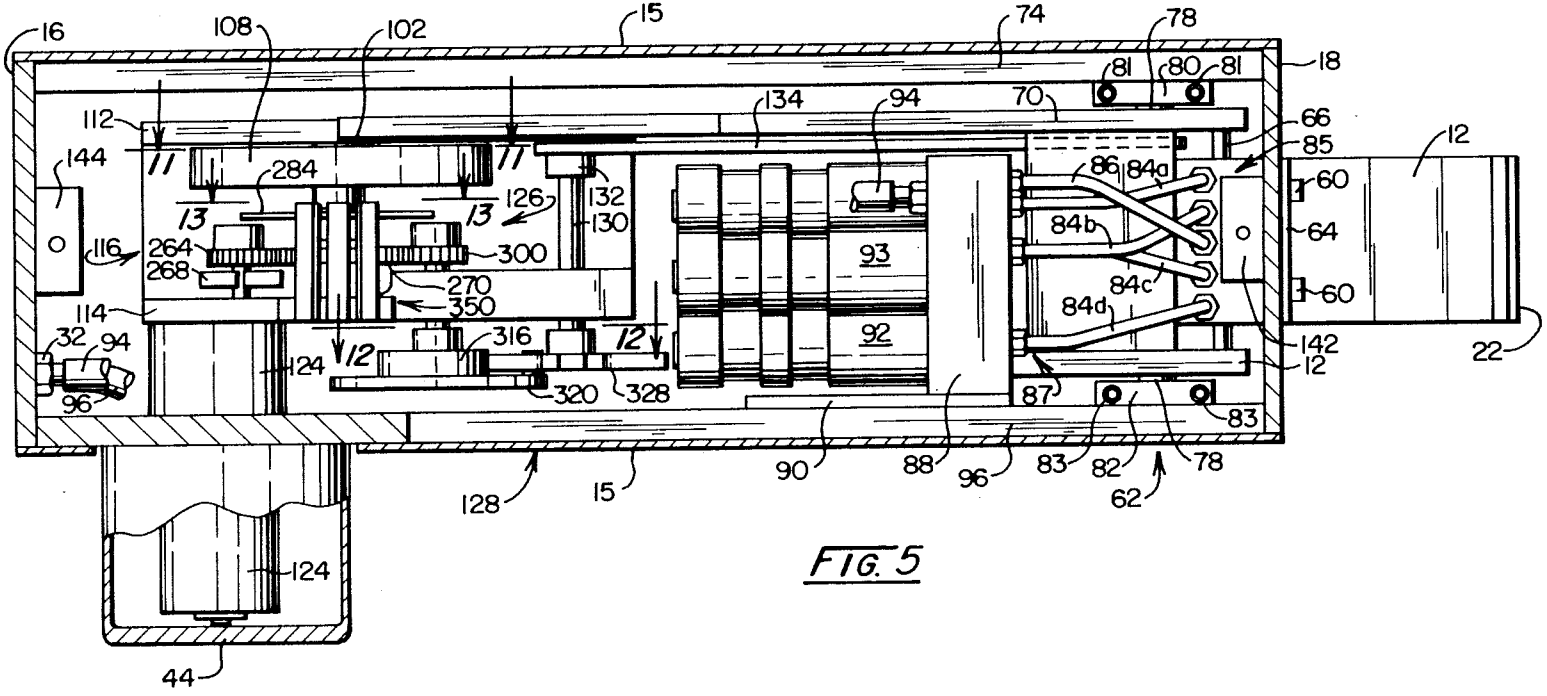
FIG. 5 is a sectional view of the apparatus of FIG. 1 taken through the plane 5—5 thereof and with portions broken away to reveal internal structure.
Figure 6:
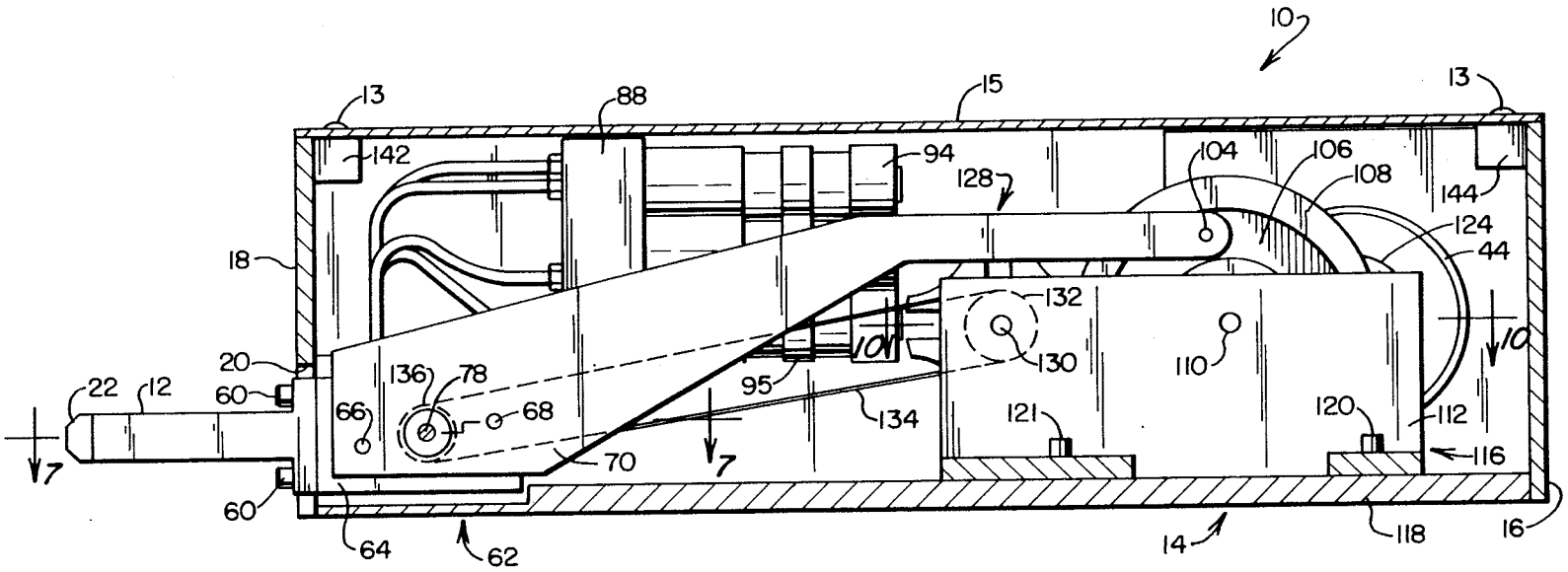
FIG. 6 is a sectional view of the apparatus of FIG. 2 taken through the plane 6—6 thereof.

Referring to FIG. 5, the general layout of the operational components of apparatus 10 are revealed. In the figure, fixturing member 26 is removed in the interest of clarity in showing head 12. In this regard, the head 12 is attached by machine screws 60 to a pivot mount represented in general fashion at 62. More specifically, the head 12 is attached to a carriage 64. Carriage 64 is mounted for lateral movement within the appartus 10 upon two polished guide rods or Thomson rods 66 and 68 which, as shown in FIG. 6, in turn are supported by bores formed in pivot mount arm 70 and oppositely disposed pivot support member 72. This laterally slideable mounting is revealed in enhanced detail in FIG. 7. Pivot arm 70 and member 72, in turn, are pivotally mounted to frame members 74 and 76 by a shaft arrangement represented generally at 78 extending to pillow block type bearing mounts 80 and 82. Pillow block mounts 80 and 82 are attached to respective frame members 74 and 76 by machine screws (not shown). These devices 80 and 82 are of a split block variety, the upper component of which is retained in place by machine screws shown, respectively, at 81 and 83. The bottom half of the block is captured by the noted connection with respective frame components 74 and 76. With the arrangement, the top components are readily removed to facilitate removal of the pivot mount assemblage.

Pneumatic drive to the chambers of the four pins within head 12 is supplied from flexible conduits **84*a*–84*d* and a return conduit is provided at 86. Conduits 84*a*–84*d* and 86 extend from an array of connectors 85 coupled to the top surface of carriage 64 to a corresponding array connectors 87 coupled to a manifold 88 fixed, by bracket 90 to frame member 76. Connected to the opposite face of manifold 88 are four solenoid driven valves 92–95 (FIGS. 5, 6, 9A and 9B) in addition to a 20 p.s.i. return air input at flexible conduit 94 extending to return connector 32 and a 100 p.s.i. supply input flexible conduit, a fragment of which is shown at 96 extending from earlier-described connector 34 (FIG. 3) to a location 255 shown in FIGS. 9A and 9B joining manifold 88 below solenoid 93**.

FIG. 6 reveals that pivot arm 70 extends rearwardly within housing 14 to support a roll type cam follower 102 mounted upon a shaft 104. Follower 102 is captured within an internally-formed cam slot 106 within a circular cam wheel 108. As revealed in FIG. 5, cam wheel 108 is mounted upon a timing shaft 110 extending between the upstanding flanges 112 and 114 of a drive mechanism support frame represented generally at 116. Frame 116 is seen in FIG. 6 to be coupled to the bottom component 118 by machine screws as at 120 and 121. Returning to FIG. 5, cam wheel 108 is driven from a d.c. electric motor 124 through a timing gear mechanism represented generally at 126. Motor 124 is mounted through frame 76 to the upstanding flange 114 of support frame 116. Gear assemblage 126 additionally functions to drive an intermittent drive provided as a Geneva mechanism represented generally at 128 and having an intermittent output at shaft 130 mounted between flanges 112 and 114 of frame 116. Shaft 130 supports a drive sprocket 132 which, in turn, conveys intermittent rotary drive from the Geneva mechanism 128 by a timing chain or belt 134. Belt 134 may, for example, be of a variety formed of polyurethane and incorporating a stainless steel braided cable within it. The belt 134 extends to a corresponding sprocket represented in FIG. 6 in phantom at 136. Sprocket 136 functions to provide the motive input to carriage 64 to cause its lateral movement upon drives 66 and 68. Finally, FIGS. 5 and 6 show that the U-shaped cover 15 is retained in place by the noted machine screws 13 extending through the cover 15 to connector blocks as at 142 and 144.

In its general operation, the vertical locus of travel of head 12 is provided by the pivotal action of pivot arm 70 operating in conjunction with the rotation of cam wheel 108, while the lateral movement of carriage 64 carrying the head 12 is controlled by timing belt 134 extending from sprocket 132. This motion is intermittent in view of the performance of Geneva mechanism 128.

Figure 7:
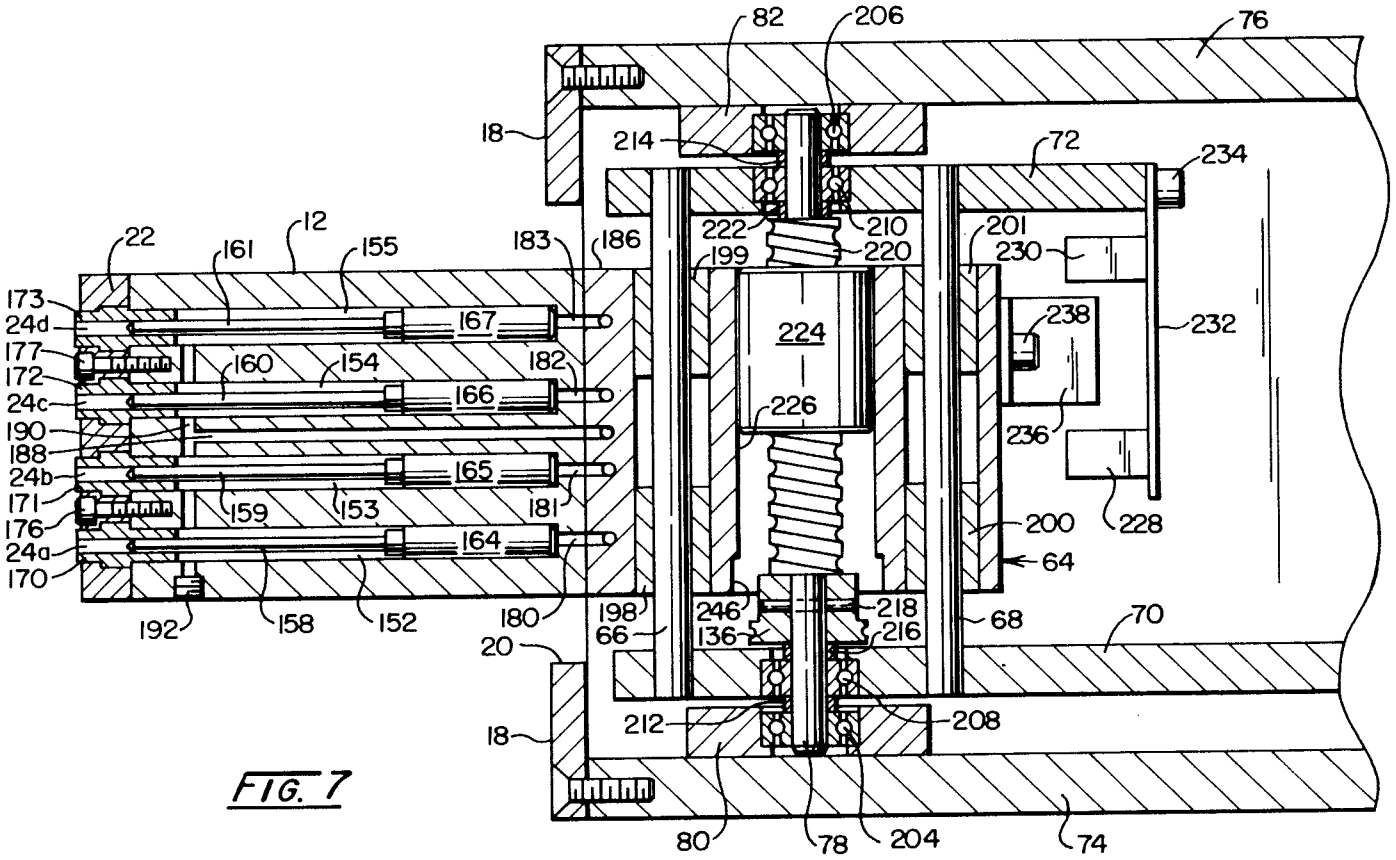
FIG. 7 is a partial sectional view of the apparatus of FIG. 6 taken through the plane 7—7 thereof.

Turning to FIG. 7, the head 12 and carriage 64 are revealed in section at an enhanced level of detail. Head 12 is formed of four elongate chambers 152–155 carrying respective marker pins 158–161 which extend from their pointed tips as shafts to respective pistons or drive portions 164–167. The shafts and impact tips of pins 158–161 are seen to extend into the inwardly-disposed ends of respective bushings 170–173 which are retained in position by the confronting portion 22 serving as an end cap and retained in place by machine screws 176 and 177. The internally disposed ends of bushings 170–173 are necked down to provide striking surfaces or end portions which limit the travel of respective pistons 164–167. These pistons 164–167 are pneumatically driven from respective conduits 180–183 which extend through a manifold configuration within carriage 64, a portion of which is revealed at 186. Thus, upon select actuation of the solenoids of valves 92–95, high pressure air is selectively passed from manifold 88 to conduits 180–183 through the earlier-described respective flexible conduits **84*a*–84*d* (FIG. 5). As any given one of the pistons 164–167 is driven outwardly, it will tend to compress return air supplied to the chambers 152–155 from conduit 188 which extends through a tee connection to conduit 190 and the chambers 158–161 in the vicinity of the necked down portion of respective bushings 170–173. Conduit 190 is seen plugged at 192. Generally, a relief valve is incorporated in the input to conduit 188 to relieve any over-pressure occasioned with the compression of return air. Preferably, this return air, for example being under a pressure of about 20 p.s.i., carries a lubricant and the advantageous technique of employing this approach for returning pistons 164–167 to a stand-by orientation as illustrated is described in detail in noted U.S. Pat. No. 4,506,999. Conduit 188 extends through manifold portion 186 in gas transfer relationship to the earlier-described flexible conduit 86 and thence to manifold 88 and conduit 94 (FIG. 5**).

Looking to the lower disposed configuration of carriage 64, it may be seen that the carriage is supported for movement upon rod 66 by ball bushings 198 and 199, while correspondingly, rod 68 is shown to extend through ball bushings 200 and 201. Bushings 198–201 are linear recirculating ball bearing devices which provide for lateral movement at minimized friction. Shaft 78 is seen to be supported within pillow block 80 at ball bearing 204 and, correspondingly, within split pillow block 82 at ball bearing 206. Similarly, pivot mount arm 70 is pivotally mounted upon shaft 78 at ball bearing 208, while pivotal mounting component 72 is supported on the opposite end of shaft 78 at ball bearing 210. A spacer 212 spaces bearings 204 and 208 while, correspondingly, a spacer 214 functions to space bearings 206 and 210. Driven sprocket 136 is shown mounted on shaft 78 spaced from bearing 208 by spacer 216 and pinned to shaft 78 by a pin assemblage 218. The pinning approach assures proper synchronization or registration of all components. Sprocket 136 is shown positioned in adjacency with a helically threaded ball screw 220 integrally formed with shaft 78 and extending to a spacer 222 adjacent the inwardly-disposed face of bearing 210. A ball nut 224 rides upon ball screw 220 within bore 226 of the carriage 64 and is fixed thereto. Device 224 also is formed carrying recirculating bearings to provide for low friction drive to the carriage 64 between its home and return positions. The ball is fixed within bore 226 of the carriage 64. Thus, as sprocket 136 is rotationally driven from belt 134 and Geneva mechanism 128, the carriage 64 is incrementally laterally moved depending upon the direction of rotation of the motor 124. The position of carriage 64 in this movement is sensed by two opto-interrupters 228 and 230 mounted upon a bracket 232 attached to pivot support member 72 by machine screws as at 234. These interrupter devices 228 and 230 are generally U-shaped, having an emitting diode in one leg and a photo-detector in an oppositely disposed leg. The devices 228 and 230 operate in conjunction with a flag 236 configured as a tag which extends outwardly from carriage 64 and is attached thereto by machine screws 238. Thus, when carriage 64 is in its home position, the flag 236 will extend within interrupter 228 to provide an output indication as to reaching this starting position. Correspondingly, as the flag 236 is located intermediate interrupter 230, a signal condition is produced showing the carriage 64 to be in the return position.

Figure 8A:
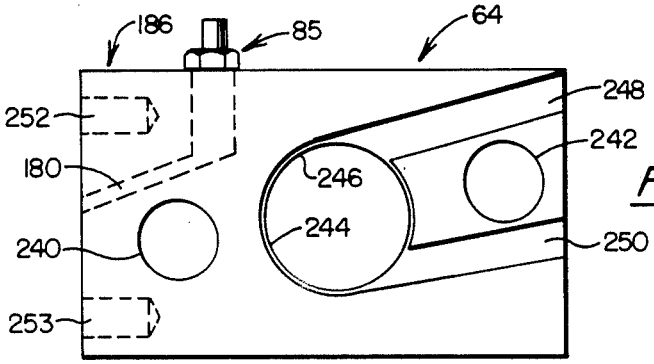
FIGS. 8A and 8B, respectively, are side and front views of a manifoldcarriage assembly shown at FIG. 5.
Figure 8B:
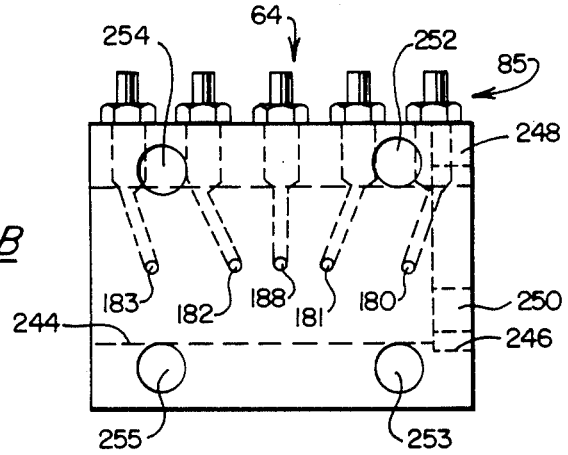

Referring to FIG. 8A, a side elevational view of the carriage 64 is revealed showing its internal manifold structure. The view shows lateral bores extending through the carriage structure 64 at 240 and 242. Bore 240 carries the assemblage of rod 66 and bearings 198 and 199, while correspondingly, bore 242 carries the assemblage of rod 68 and associated bearings 200 and 201. A bore of larger diametric extent at 244 is shown to provide for the retention of ball nut 224 and a relief is provided thereabout at 246 in the form of a counterbore which extends upwardly and rearwardly as at channel 248 and in similar fashion at 250 to provide clearance for the belt 134 when carriage 64 is in its home orientation adjacent the sprocket 136. Looking additionally to FIG. 8B, these relief components again are revealed. The manifold structure portion 186 of carriage 64 is shown to include earlier-described conduits 180–183 which extend to the array of connectors 85. Portion 186 additionally includes threaded bores as at 252 and 253 of a grouping of four thereof as shown in FIG. 8B as including additionally bores 254 and 255 provided for receiving machine screws 60 (FIG. 5). FIG. 8B further shows the angularity of the conduits 180–183 and 188 extending to the array of connectors 85.

Figure 9A:
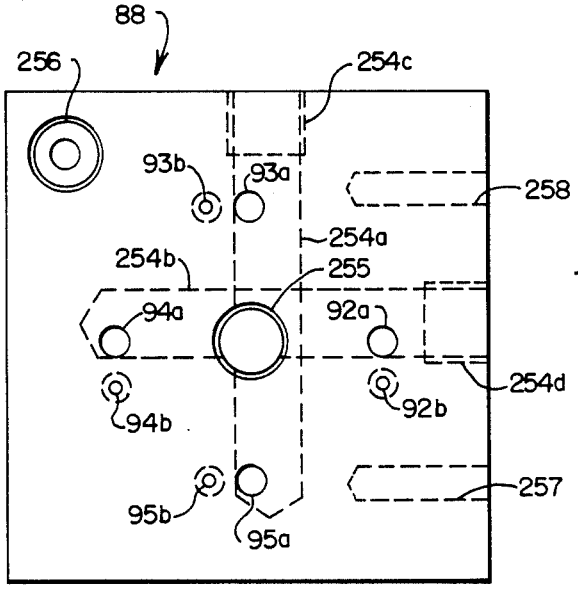
FIGS. 9A and 9B, respectively, are top and rear views of a solenoid manifold shown in FIG. 6.
Figure 9B:
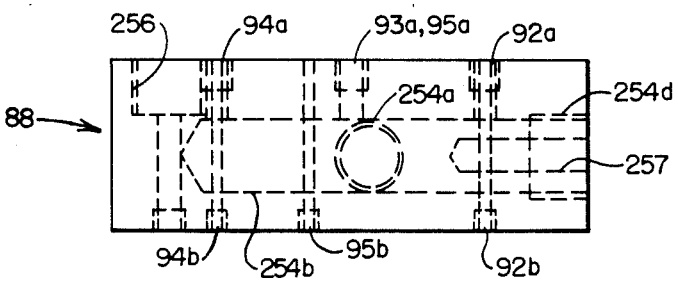

Referring to FIGS. 9A and 9B, the internal structure of solenoid manifold 88 is revealed. The figures show two cross feeder bores **254*a* and 254*b* which are plugged, respectively, at 254*c* and 254*d*. These feed bores are fed by an input line 96 (FIG. 5) which is fed by an external pneumatic connection 34 (FIG. 3). Solenoid driven valves 92–95 are configured as two stage devices having an inlet valve and an outlet valve. The inlet valves of the solenoids 92–95 are threadably attached to tapped bores shown, respectively, at 92*a*–95*a* which access the pressurized air input from bores 254*a* and 254*b*. The outlets of the two-stage valves are provided as tubular outlets which slide through bores extending through the base component of the manifold 88. In this regard, the outlet tubes for solenoids 92–95 extend through respective bores 92*b*–95*b* to extend to the opposite side of the manifold for fluid tight association with the output connectors shown in FIG. 5 at 87. Manifold block 88 is attached as above described to frame components as at 90 by threaded bores 257 and 258**.

Figure 10:
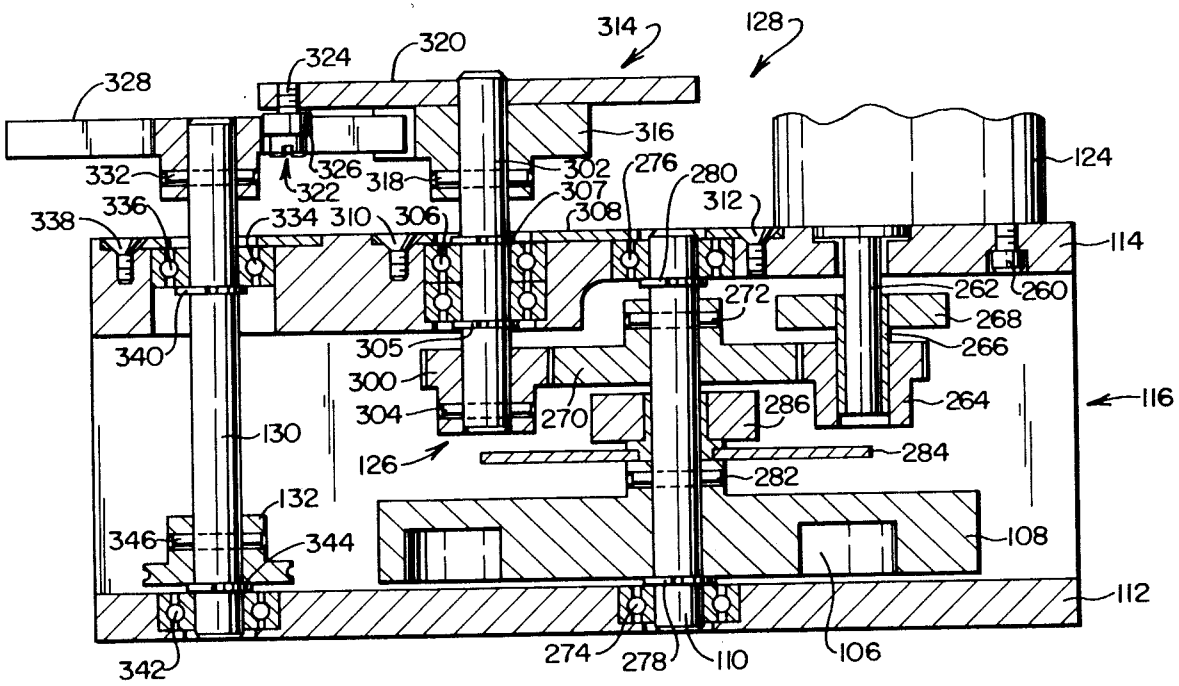
FIG. 10 is a partial sectional view of the apparatus of FIG. 6 taken through the plane 10—10 thereof.

Turning to FIG. 10, the components constituting timing components 126 and Geneva mechanism 128 are revealed at an enhanced level of detail. In the figure, motor 124 is seen to be coupled to flange component 114 at one position by a machine screw 260. The motor is so retained such that its output at shaft 262 extends to a spur gear 264. To provide the requisite larger shaft diameter, a shaft adapter 266 is provided which is retained in place by a split hub clamp 268. Gear 264 is meshed in driving relationship with spur gear 270 in a 2:1 driving ratio to provide for drive input to timing shaft 110. In this regard, it may be noted that gear 270 is pinned to shaft 110 at 272. Shaft 110 is seen to be supported by ball bearings 274 and 276 supported, in turn, by respective flanges 112 and 114. Additionally, the timing shaft is retained in place by split ring retainers 278 and 280. Cam wheel 108 is coupled to timing shaft 110 by a pin arrangement 282 and next adjacent to that connection, the shaft carries a timing disk 284 secured thereto by a split hub clamp 286.

Figure 11:
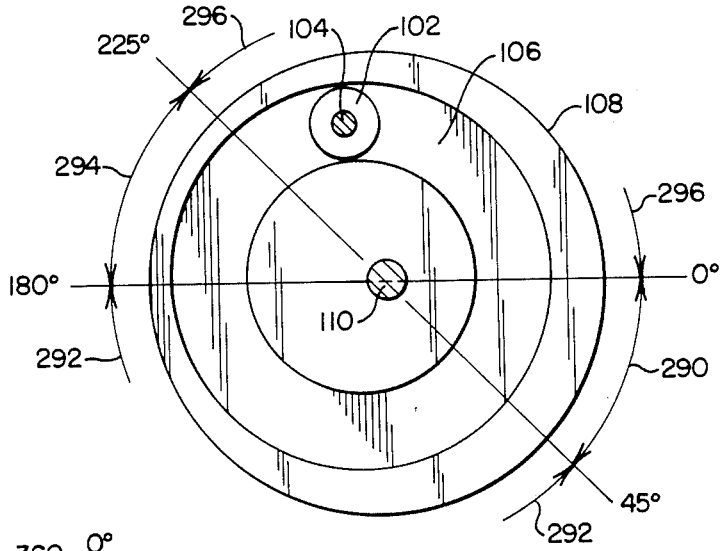
FIG. 11 is a partial sectional view of the apparatus of FIG. 5 taken through the plane 11—11 thereof.

Now considering the traverse of the head 12 with respect to its pivotal movement about the axis of shaft 78, cam wheel 108 is called upon to provide a downward pivoting movement as well as an oppositely directed upward pivoting movement with each of its revolutions. Additionally, following such pivotal movement, the cam 106 is called upon to dwell until such time as indexing in the home or away directions can be carried out by the Geneva mechanism 128. Referring to FIG. 11, a view of the internally-formed cam 106 is presented along with follower 102 which, as described in conjunction with FIG. 6 is coupled to pivot arm 70 by shaft 104. FIG. 11 shows that the cam 106 is designed to have a constant radius during such interval as the head 12 is at an extreme pivotal up or down position. Accordingly, FIG. 11 shows cam 106 to define a minimum radius for a 45° interval as labeled at 290. From 45° to 180° as designated at 292, the cam 106 radius increases linearly to a maximum radius value causing the head 12 to be deflected to the extreme lower traverse point and a dwell is provided from 180° to 225° as represented at 294. This region of maximum but constant radius then is followed by the cam region from 225° through 360° where the radius decreases linearly to minimum radius at 0°. To assure the linearity of the vertical extent of this character defining system, it is necessary to maintain a constant value for the expression: (RADIUS max.–RADIUS min.)/2. In this regard, it may be noted in FIG. 6 that the center 104 of the cam follower 102 is not directly above shaft 110 of the cam wheel 108.

Returning to FIG. 10, spur gear 270 attached to timing shaft 110 additionally is seen to be enmeshed with a spur gear 300 which is coupled to driver shaft 302 by a pin connection 304. Gears 270 and 300 are structured to provide a 2:1 ratio such that driver shaft 302 turns twice as fast as timing shaft 110. Shaft 302 is shown supported within frame flange 114 by a dual bearing assembly 306. Bearing assembly 306 and 276 are shown retained in position by cover plate identified at 308, in turn, retained against the outer face of flange 14 by machine screws 310 and 312. Split ring retainers 305 and 307 provide interiorly disposed bearing securement and shaft positioning. Driver shaft 302 functions to drive the Geneva mechanism 128 by virtue of its connection to a driver assemblage 314 comprised of a hub 316 which is pinned at pin connection 318 to shaft 302 and an outwardly disposed drive disk 320. Looking additionally to FIG. 12, it may be observed that disk 320 carries a drive pin 322 formed of machine screw 324 and bearing 326 which selectively nests within one of the four slots of a four point Geneva output component 328. Component 328 is configured to mechanically cooperate with the arcuate profile of hub 316 and is mounted upon output shaft 130 by a pin connection shown in FIG. 10 at 332.

With this arrangement, a 180° rotation of the timing shaft 110 will cause a 360° rotation of the driver shaft 302. The Geneva mechanism 128 is a 360° to 90° four point device and is synchronized to the cam 106 in such a manner that the 0° through 45° region 290 and the 180° through 225° region 294 positions of cam 106 coincide with a 90° rotation of the Geneva mechanism output shaft 130. Thus, rotation of the output shaft 130 occurs when there is no change in the cam radius and, therefore, no change in the vertical position of the head 12.

Shaft 130 is seen to be supported for rotation at flange component 114 by bearing 334 which is retained by a cover plate 336 and machine screw 338 as well as by split ring 340. The opposite side of shaft 130 is supported by bearing 342 located within flange component 112. A split ring 344 functions to locate the shaft 130 and retain bearing 342 in place. Drive sprocket 132 is seen retained upon shaft 130 by pin connection 346. When functioning to drive the ball screw 220 (FIG. 7) from timing belt 134 a 90° rotation will cause a horizontal shift of carriage 64 equal to one pixel or dot space.

Figure 16:
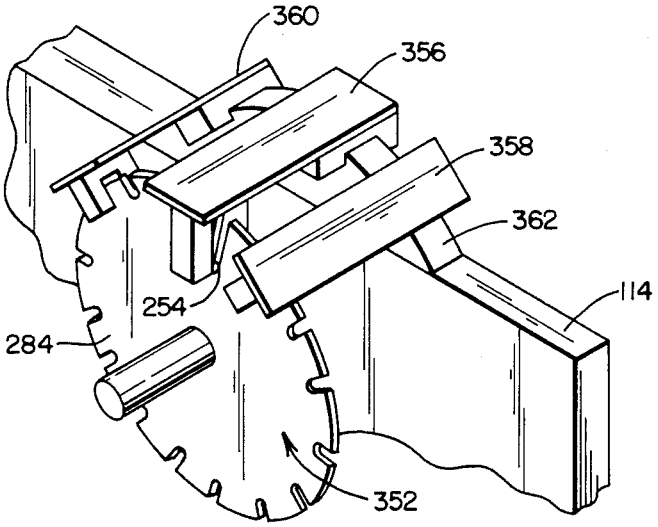
FIG. 16 is a perspective view showing a timing disk and associated optical detector components employed in the apparatus of FIG. 1.

Returning to FIG. 5, the optical interrupter disk 284 is shown, as described above, mounted for co-rotation with cam wheel 108 on timing shaft 110. This disk contains a sequence of 16 circumferentially disposed openings or slots which are employed to provide pixel signals as interrupts to the control function of the apparatus 10 to enable actuation of the solenoid valves 92–95 and effect the driving of a given marking pin into the surface being marked. Additionally, a synchronizing opening is provided to establish the initial orientation of the system. These interrupt openings are detected by three optical interrupters shown in general in FIG. 5 at 350 as mounted and extending from flange component 114 of frame 116. Referring additionally to FIG. 16, a pictorial perspective representation of the disk 284 and detectors 350 is revealed. The array of circumferentially disposed interrupt openings is shown at 352 at one given radius on the disk 284, while a singular synchronizing opening is shown at 354. These openings are detected by the noted optical detectors 350 which include a synchronizing detector 356 which functions to detect the presence of opening 354, a clockwise rotational detector 358 which is operative during a clockwise rotation of disk 284 and, correpsondingly, a counter-clockwise rotation detector at 360. These devices are mounted and are adjustable upon a bracket 362 mounted, in turn, upon flange component 114. Thus, as the disk 284 is rotated in a clockwise or counter-clockwise direction, the detector 356 will detect the synchronizing interrupt opening 354, while an appropriate one of the detectors 358 or 360 will detect the interrupt openings from array 352, enablement being predicated upon direction of rotation. In this regard, the detectors at 358 and 360 are formed of a light emitting diode located within one leg of their U-shaped structure and a photo-detector in the opposite leg. By energizing the emitting diodes in conjunction with the motor 124 drive polarity, one diode will be forwardly biased and the other back biased (off) depending on motor direction.

Figure 13:
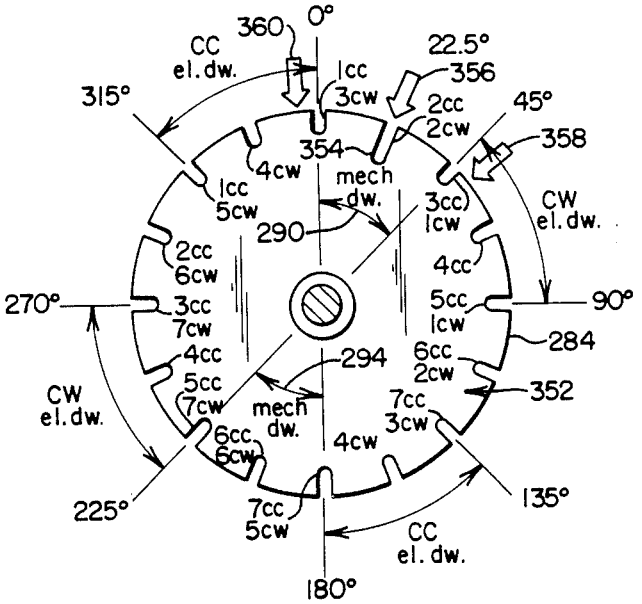
FIG. 13 is a partial sectional view of the apparatus of FIG. 5 taken through the plane 13—13 thereof.

Looking additionally to FIG. 13, it may be observed that there are 16 interrupt openings of the array 352 to provide the seven possible pixel defining interrupt signals or pixel signals for a vertical stroke from top to bottom of a character and then from bottom to top. These interrupt openings of array 352 are configured for performance in either a clockwise or counter-clockwise direction of rotation of the disk 284 and, consequently, cam 108. Additionally shown in FIG. 13 are the relative locations of the optical detectors 356, 358 and 360, their relative orientations being represented by arrows having the same identifying numeration. The system will not perform until such time as the synchronizing opening 354 has been detected by the detector at 356. Due to the timing delays which occur from the time of an optical detect through an opening of array 352 to solenoid valve 92–95 energization, marking pin actuation and, ultimately, the impact on the piece to be marked, it is necessary to position the detectors 358 and 360 in advance of the desired cam angular position for a given rotational aspect in order for the vertical deflection of the stamping pins to coincide with the proper pixel or dot in the 5×7 character defining matrix. Two pixel detectors 358 and 360 are used such that detection can be located in advance of the desired cam angle of rotation when the device is stamping from home towards away or vice versa. In the figure, the interrupt openings of the array 352 are assigned a pixel position from 1–7 representing one column of a 5×7 character matrix. In this regard, following the synchronizing opening 354, those openings providing interrupt signals for clockwise rotation in the sense of FIG. 13 are assigned a label 1cw through 7cw, whereupon, the next succeeding opening is within an electrical dwell (cw. el. dw.). The procedure will develop interrupt or pixel signals for the opposite vertical direction of movement of the head 12 and the openings in this regard are seen to be labelled 7cw through 1cw, whereupon a next electrical dwell (cw. el. dw.) is encountered and the eighth such pixel is ignored. It is during these electrical dwells that the noted horizontal indexing of the head 12 occurs. Operating in the opposite direction in conjunction with detector 360, the interrupt openings are labelled 1cc through 7cc, whereupon an eighth interrupt opening is ignored within the counter-clockwise electrical dwell (cc. el. dw.), the latter opening being at the noted 4cw location. The counter-clockwise array of openings then continues as labelled from 7cc through 1cc whereupon a counter-clockwise electrical dwell (cc. el. dw.) is encountered and the next interrupt opening, labelled 4cw is ignored.

Figure 15:
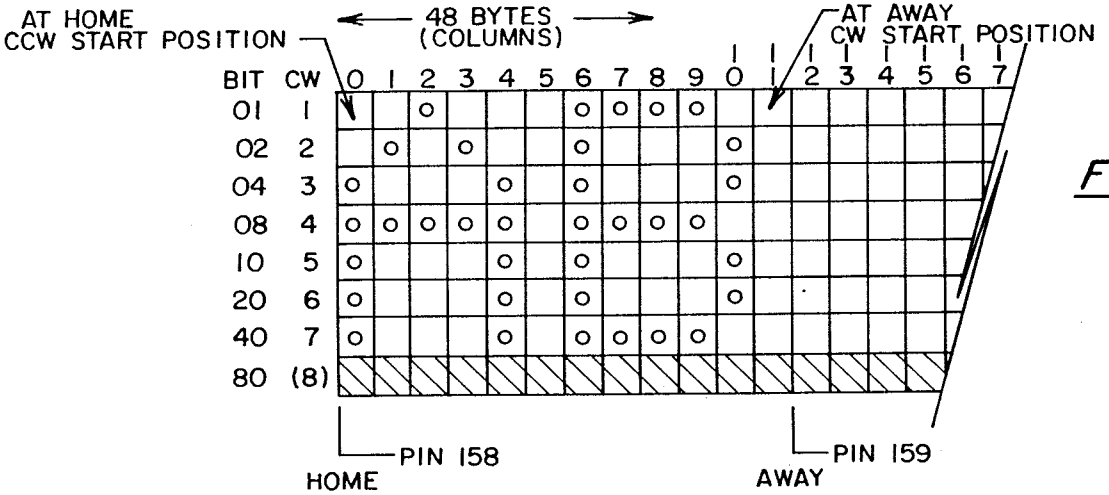
FIG. 15 is a partial diagrammatic representation showing the relationship of pixel locations within a stamping matrix and corresponding column and row control logic.

Looking momentarily to FIG. 15, the microprocessor utilization of these interrupts is represented for one pin of the grouping 158–161, it being understood that all pins operate simultaneously with respect to their designated marking regions. Additionally, home and away positions are represented in the drawing. For a 5×7 matrix, the above-noted clockwise pin positions 1–7 are represented as a byte of data, the eighth location in the byte being labelled "8" in the shaded region of the drawing. In the counter-clockwise direction, note that the pixel designations reverse from 7 through 1. Thus, by appropriate character defining masking, signals for generating the noted characters are readily developed for actuating the pin array. Note that one pixel column spacing is provided between characters and the beginning position of the head determines where appropriate computer pointers are located with respect to the location of control head 12 in consonance with the direction of its travel.

Figure 17A:
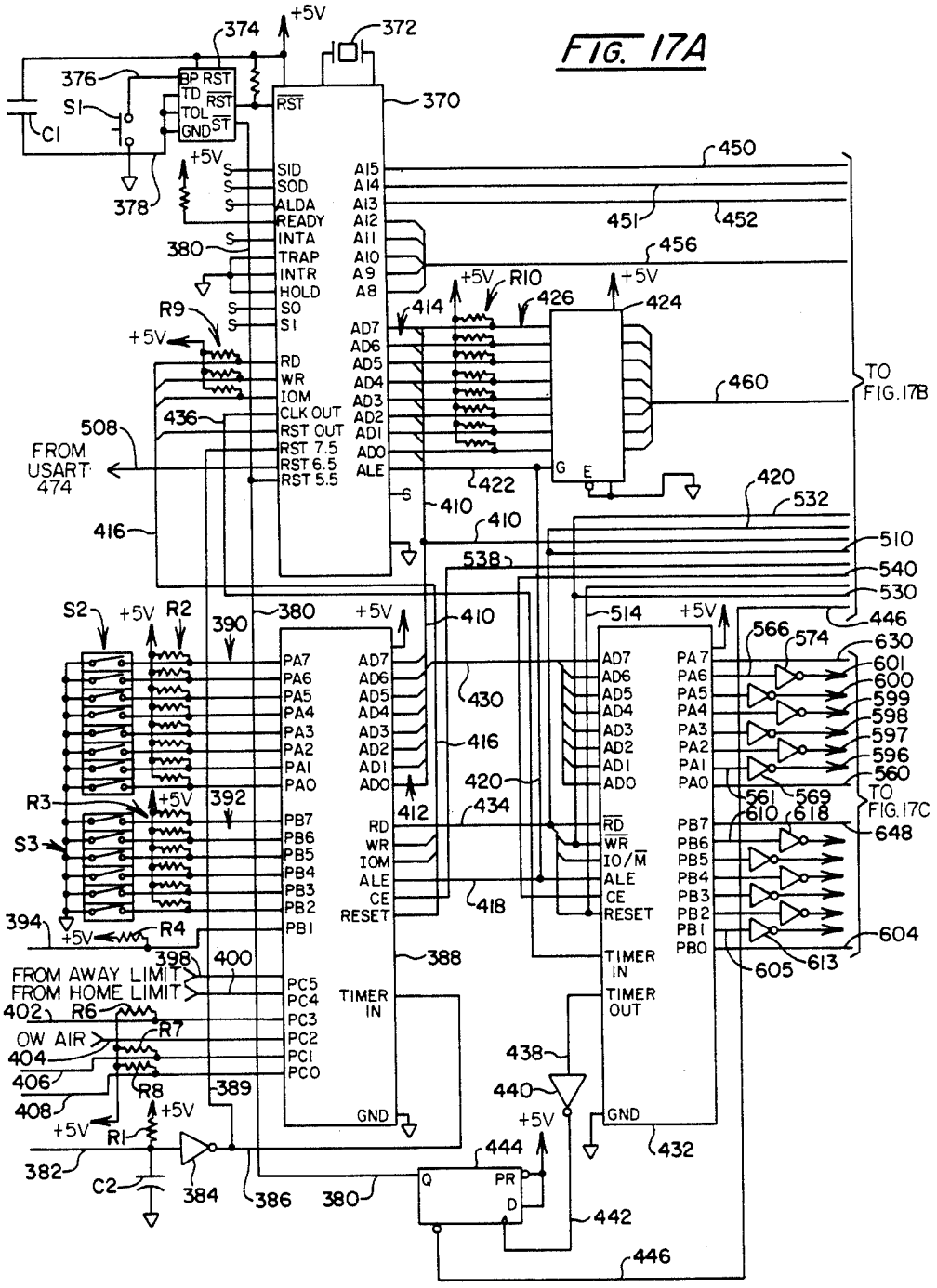
FIGS. 17A–17C combine to show an electronic schematic diagram of the control system employed with the apparatus of FIG. 1.
Figure 17B:
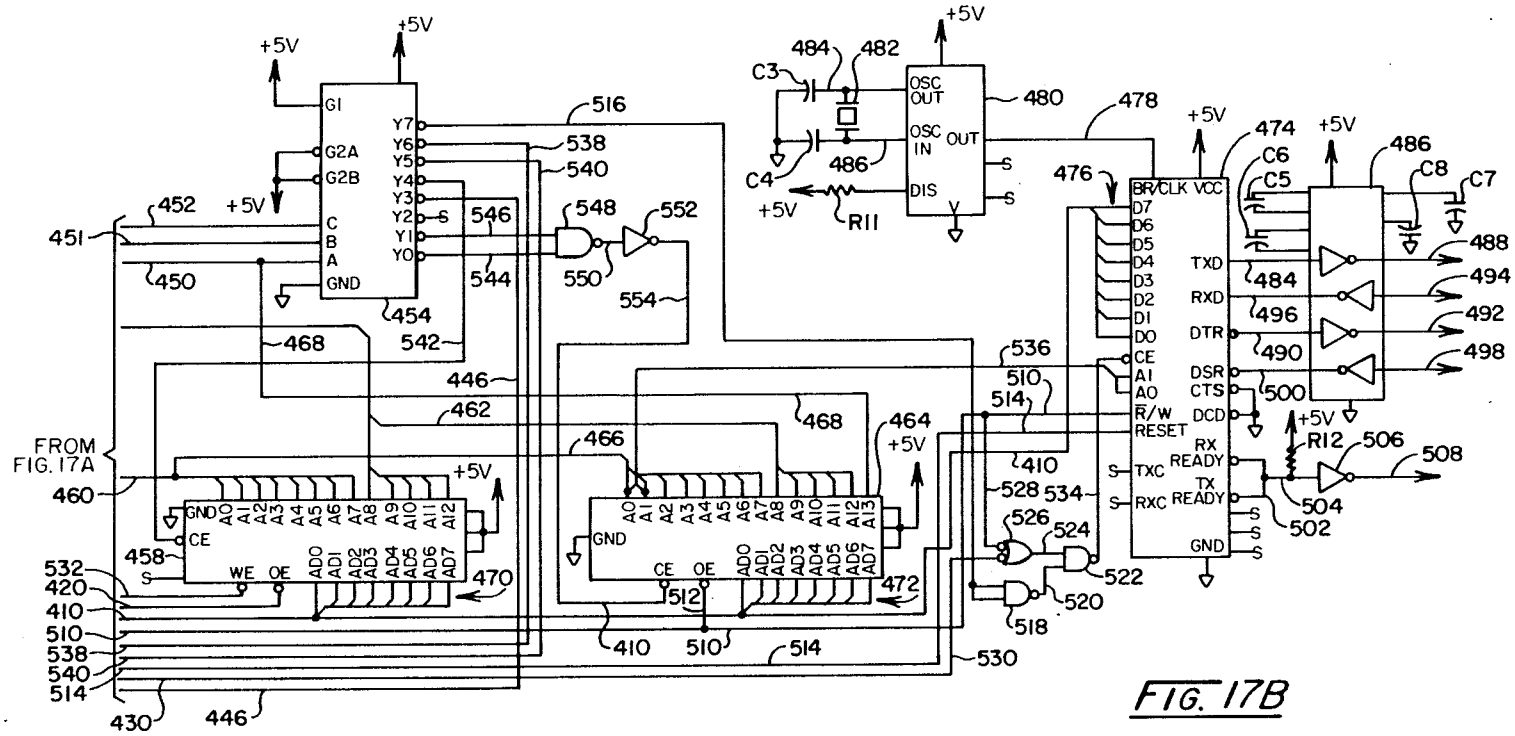
Figure 17C:
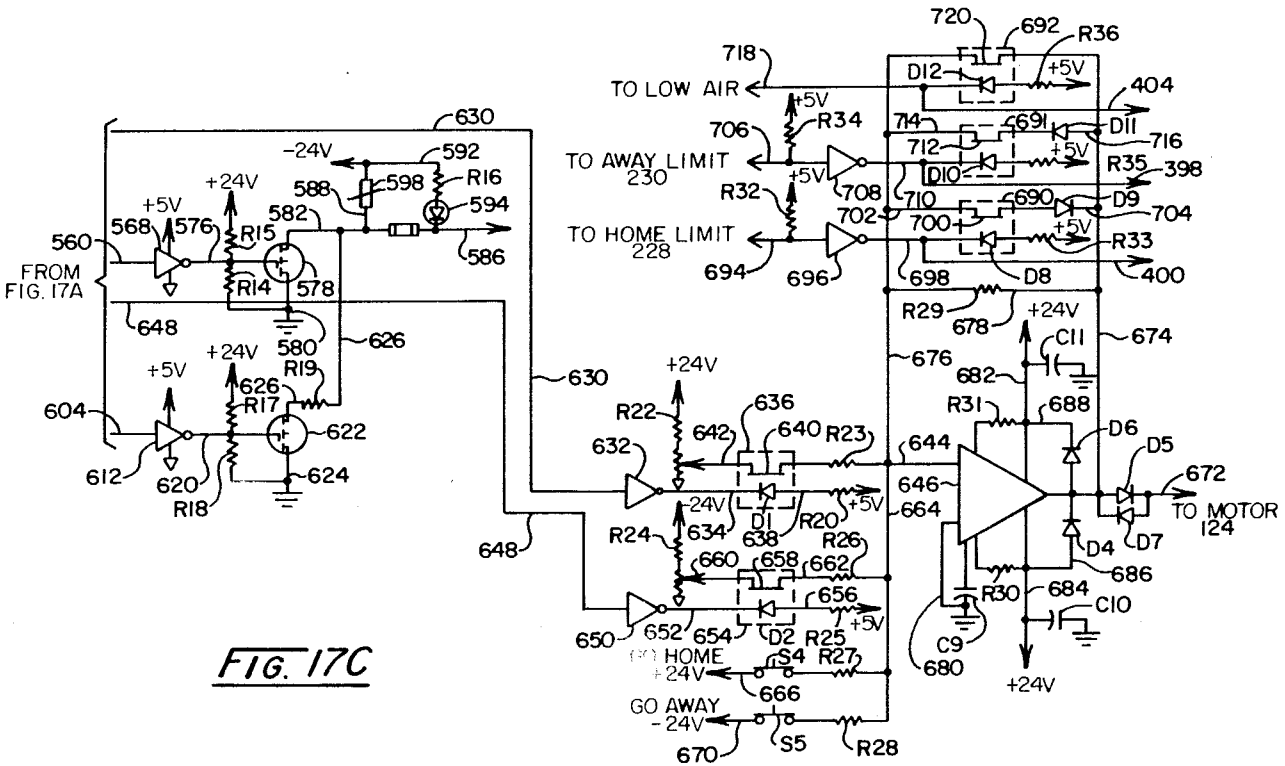

Referring to FIGS. 17A–17C, an electrical schematic representation of the control asserted over the solenoid driven valve grouping 92–95, as well as the motor 124 is provided. These figures should be considered in the orientations represented by their intermutual labeling.

FIG. 17A shows the control to be microprocessor driven, in this regard employing an 8-bit HMOS microprocessor 370 which may, for example, be a type 8085 marketed by Intel Corporation. Microprocessor 370 performs in conjunction with an 8 MHz clock input provided, for example, by a crystal 372. The high level-sensitive reset input RST 5.5 to the microprocessor 370 is derived from the RST output of a micromonitor 374 which responds not only to hand actuations of a switch S1 coupled to the device via lines 376 and 378, but also from line 380 leading to power-down components of the circuit. In effect, the device 374 functions to reset the device 370 quickly in the event either of actuation of switch S1 or of a power drop, for example, occasioned during power down to avoid spurious writing to memory under such events. A filtering capacitor C1 is shown coupled about switch S1 within line 378.

Microprocessor 370 operates in a program interrupt fashion in conjunction with the timing disk pixel signals derived at opto-detectors 358 and 360 (FIG. 12) and the latter signals are introduced thereto from along line 382, whereupon they are introduced to the input of an inverting Schmitt trigger 384 which functions, inter alia, to improve the rising edge characteristic of the timing disk developed pulse. This input at line 382 is pulled up to +5v through resistor R1 and is filtered by capacitor C2 shown coupled between line 382 and ground. The output of trigger 384 at line 386 is shown being directed via line 389 to the RST 7.5 terminal of microprocessor 375 which reacts thereto in interrupt programming fashion. Line 386 also is directed to the timer in port of a type 8155 RAM-I/O-timer device (RIOT) 388. Device 388 is multi-functional incorporating random access memory (RAM) as well as input/output functions and timing functions. In the latter regard the pixel defining pulse at line 386 asserted thereto is divided down for timing purposes in the system. The I/O function of device 388 is provided at the P designated terminals. In this regard, it may be observed that terminals PA0–PA7 are coupled through lead array 390 to the d.i.p. switch array represented at S2. Each of the leads within array 390 are coupled to +5v through a pull-up resistor of resistor array R2. Similarly, terminals PB2–PB7 are coupled through lead array 392 to an array of corresponding d.i.p. switches identified at S3. Each of the leads 392 is coupled to +5v through pull-up resistors represented at resistor array R3. Switches S2 and S3 may be selectively manipulated by the user to provide any of a number of functional parameters for operation of the system. Such parameter selections may, for example, include election of different system configurations, for example, in the matrix defining the characters such as a 5×7 type or 5×5 type character font, baud rate configurations, handshake protocols, count rates and the like. The synchronizing pulse as developed from opening 354 in timing disk 284 and detected by opto-detector 356 (FIG. 12) enters the control system from along line 394 whereupon it is treated by pull-up resistor R4 coupled to +5v and submitted to the PBI input terminal of device 385. Adjacently disposed lines 398 and 400 are shown directed, respectively, to the PC5 and PC4 terminals of device 388 and carry the status of the home and away opto-detector 228 and 230 (FIG. 7). Device 388 also forms the input for push-button type commands and the like which may be desired for the system. For example, the solenoids may be selectively pulsed for diagnostic purposes by a signal presented along line 402 as coupled to +5v through pull-up resistor R6. Low air may be monitored and the status thereof provided at line 404. An abort signal input may be provided, for example, along line 406 which is coupled through pullup resistor R7 to +5v and a command to print or actuate the solenoid driven devices to create a message may be provided by command at line 408 which is shown coupled to +5v through pull-up resistor R8.

The address ports of RIOT 388 as at AD0–AD7 are shown coupled to the microprocessor 370 through the eight lead microprocessor bus 410 via lead array 412. Bus 410 may be seen directed to the corresponding AD0–AD7 address-data ports of microprocessor 370 through lead array 414. Control input to device 388 at its RD, WR, IO/M, and reset inputs are provided from four line bus 416 which extends to the corresponding terminals of microprocessor 370. In this regard, it may be noted that the $\overline{RD}$, $\overline{WR}$, and IO/$\overline{M}$ ports are coupled through pull-up resistor array R9 to +5v. The address latch enable (ALE) terminal of device 388 is coupled via lines 418, 420 and 422 to the corresponding ALE input of microprocessor 370. Line 422 additionally is seen to extend to the G input terminal of a latch 424 which may be provided, for example, as a type 74ALS573. The remaining inputs to latch 424 are provided from eight lead bus 410 via lead array 426, the discrete line inputs thereof being coupled through the resistors of resistor array R10 to +5v.

Eight lead bus 410 leading from the address/data ports of microprocessor 370 also is seen to branch at bus 430 to address a second type 8155 RIOT device 432 at the corresponding AD0–AD7 ports thereof. Additionally, it may be observed that control inputs via four lead bus 416 are provided via branch 434 to the $\overline{RD}$, $\overline{WR}$, IO/$\overline{M}$ and reset terminals of device 432. Line 418 commonly connects the address latch enable (ALE) terminals of devices 388 and 432. The timer input of device 432 is employed and in this regard, the clock output of microprocessor 370 is shown coupled to that input via line 436. The timer output of device 432 is coupled via line 438 to an inverter buffer 440 and from the output thereof at line 442 to the input of a D flip-flop 444 which may, for example, be provided as a type 74LS74A. The clear input to flip-flop 444 is provided from line 446 and the Q output thereof is coupled via earlier-described line 380 to restart input RST 5.5 of microprocessor 370 and to the $\overline{ST}$ input of micromonitor 374. With the arrangement, when the output at line 438 is high, flip-flop 444 is clocked to a logic high value to provide an interrupt.

Address terminals A13–A15 of microprocessor 370 are coupled via respective lines 450–452 to the corresponding A–C inputs of a three line to eight line decoder shown in FIG. 17B at 454. Adjacently disposed address terminals A8–A12 of microprocessor 370 are shown coupled by five line bus 456 to the corresponding terminals A8–A12 of a calendar and real time device 458 (FIG. 17B) which further incorporates a CMOS random access memory (RAM) feature which is non-volatile by virtue of an embedded lithium energy source. Device 458 further monitors $V_{cc}$ for any out of tolerance condition. When such condition occurs, the source is switched on and write protection is enabled to prevent loss of watch or calendar and RAM data. Such devices are marketed under the designation "Smart-watch" type DS1216 by Dallas Semi-Conductor, Inc. The remaining address terminals A0–A7 of device 458 are coupled to eight line bus 460 leading, in turn, to the A0–A7 output terminals of latch 424. Bus 456 additionally is seen to branch at bus 462 for connection with address inputs A8–A12 of a programmable read only memory (PROM) 464. Memory 464 may be provided, for example, as a type 27128 16K×8 KUV erasable PROM having an output enable (OE) which is separate from the chip enable control (CE). The device is marketed, for example, by Intel Corporation. PROM 464 additionally is addressed from eight line bus 466 branching from bus 460 leading, in turn, to latch 424. The A13 terminal of PROM 464 is seen coupled to line 450 via line 468. Address/data terminals AD0–AD7 of both devices 458 and 464 are shown coupled from respective lead arrays 470 and 472 to the microprocessor bus 410.

Bus 410 additionally is seen to extend to the data input terminals D0–D7 of a universal synchronous-/asynchronous data communications controller (USART) 474 through lead array 476. Device 474 accepts programmed instructions from bus 410 for supporting serial data communication disciplines and, conversely, provides for parallel outputting at bus 410 of serially received data. Its baud rate generator input clock (BR/CLK) is seen to be coupled via line 478 to the output of a CMOS clock generator 480. Provided, for example as a type ICM 7209 marketed by General Electric-Intersil, generator 480 is comprised of an oscillator having a buffered output corresponding therewith and performs in conjunction with a crystal oscillatory device operating at 5.0688 MHz as represented at 482 coupled between lines 484 and 486, in turn incorporating filter capacitors C3 and C4. A disable terminal (DIS) of device 480 is shown coupled through resistor R11 to +5v.

The data transmitting output of USART 474 is provided at line 484 which, in turn, is directed to a dual RS-232 transmitter/receiver 486. Provided, for example, as a model MAX 232 marketed by Bell Industries, Inc. of Dayton, Ohio, the device contains two RS-232 level translators which convert TTL/CMOS input levels into ±9v RS-232 outputs. Additionally, two level translators are provided as RS-232 receivers which convert RS-232 inputs to 5v TTL/CMOS output levels. Accordingly, line 484 is seen directed to an output level translator to provide a corresponding RS-232 output at line 488. In similar fashion, the data terminal ready signal at line 490 is directed to the second RS-232 level translator-transmitter for transmission via line 492. Receipt of serial data is provided at line 494 which is directed through the receiver level translator of device 486 for presentation at line 496 to the data receiving terminal (R×D) of USART 474. Finally, the data set ready input is provided at line 498 for level translation at device 486 and presentation to the DSR input of USART 474 via line 500. The receiver ready and transmitter ready output terminals of USART 474 are coupled in common at lines 502 and 504, the latter being coupled through pull-up resistor R12 for presentation through Schmitt trigger inverter 506 to the microprocessor restart interrupt terminal RST 6.5 via line 508. Read/write logic input to device 474 is provided from line 510 which is seen to extend in common to the output enable (OE) terminal of EPROM 464 via line 512 and to line 420 which additionally extends to the output enable (OE) terminal of RAM 458. Line 420 has been described in conjunction with FIG. 17A as being coupled to the ALE terminal of microprocessor 370 via line 422. A reset input to device 474 is provided from line 514 which is coupled to the corresponding reset input to RIOT 432 (FIG. 17A) which is controlled, in turn, via branch bus 434 from the reset out terminal of microprocessor 370. Enablement to device 474 emanates from decoder 454 at terminal Y7 thereof and line 516 which is seen to extend to both inputs of a NAND gate 518 the inverted output of which at line 520 is directed to one input of a two input NAND gate 522. The opposite input to gate 522 is provided at line 524 from NOR gate 526. Gate 526 receives one output from the read/write command at line 510 via line 528 and an opposite input from line 530 extending, in turn, to line 532. As seen in FIG. 17A, line 532 is joined with the write input line of bus 434, extending, in turn, to four line bus 416 and microprocessor 370.

Returning to FIG. 17B, line 532 also is seen to extend to the write enable (WE) terminal of RAM-clock device 458. With the above input logic, NAND gate 522 provides a chip enable ($\overline{CE}$) input to device 474 via line 534. Finally, the internal register select terminals A0, A1 of device 474 are coupled via line 536 to the two leads of branch bus 466 extending to the A0, A1 input terminals of PROM 464.

The Y6 terminal of decoder 454 provides an enable output at line 538 which extends, as shown in FIG. 17A to the chip enable (CE) input terminal of RIOT 388. Similarly, the Y5 terminal of decoder 454 extends via line 540 to the corresponding chip enable (CE) terminal of RIOT 432. Output terminal Y4 of decoder 454 is coupled via line 542 to the chip enable (CE0 input of RAM-clock device 458. Next, terminal Y3 of decoder 454 is seen to be coupled via line 446 to the clear input of flip-flop 444 (FIG. 17A). Finally, the Y0 and Y1 terminals of device 454 are coupled via respective lines 544 and 546 to the inputs of NAND gate 548, the output of which at line 550 is directed to the input of inverting Schmitt trigger 552, the output of which at line 554 provides a PROM enable input to the CE terminal of memory PROM 464.

Returning to FIG. 17A, the output of RIOT 432 at terminal grouping PA0–PA6 is employed for one aspect of drive to the solenoid-valve devices 92–95. With the arrangement shown, an output drive capability of six such solenoids is represented at the line array extending between lines 560 and 566. Each of these lines is shown directed to the input of respective inverter buffer-drivers 568 (FIG. 17C) and an array extending between buffers 569 and 574. These drivers provide high-voltage open-collector outputs which function to drive high current loads as are encountered with solenoid driven devices. Four of these drivers are employed for the four-pin embodiment of the instantly described apparatus. Looking to FIG. 17C, one of the driver outputs is represented in detail with respect to line 560 and driver 568, it being understood that the remaining outputs at 561–566 are similarly configured. Driver 568 is shown coupled between +5v and ground and provides an output at line 576 which is coupled to the gate of a MOSFET transistor 578. Transistor gate bias is applied to line 556 by a network of resistors R14 and R15 coupled between +24v supply and terminal line 580 leading to ground. Terminal line 582 extends through a pico fuse 584 and to output line 586 extending to the solenoid winding of one of the solenoid driven valves 92–95. Line 582 is coupled by line 588 incorporating a metal oxide varister (MOV) 590 to +24v supply and the latter supply is coupled by line 592, incorporating a current limiting resistor R16 and light emitting diode (LED) 594 which, in turn, is coupled to line 586. MOV 598 provides a protection against inductive spikes and the like, exhibiting a clipping function, while LED 594 functions to the illuminated with each solenoid activation and may be employed for diagnostic purposes. Similar outputs as at line 586 deriving from terminals PA1–PA6 of RIOT 432 are represented at lines 596–601. Of the above, lines 586, and 596–598 are applied to the windings of solenoid driven valves 92–95.

Where desired, a feature may be provided by the instant circuitry for enhancing the turn-off characteristics of the solenoid driven valves. With such an arrangement, a higher value current is used to initially drive the windings of the solenoids which, following for example 4 milliseconds, will be reduced to a holding value at the time of full valve actuation. At the time of termination of energization of the solenoid winding, then the lower value of current may be turned off and valve closure occurs with an improved performance. For such a feature, terminals PB0–PB6 of RIOT 432 are provided. The latter terminal groupings are shown coupled by respective line 604 and the array of lines extending between lines 605 and 610 to respective inverter/drivers 612 (FIG. 17C) and those within the array between drivers 613 and 168. As in the above case, only the output at line 604 to inverter driver 612 (FIG. 17C) is shown in full detail, it being understood that the treatment of the outputs for each of the drivers through that at 618 is identical. The output of driver 612 at line 620 is shown coupled to the gate of MOSFET transistor 622. Line 620 is provided a gate bias by the combination of resistors R17 and R18 coupled between +24v supply and line 624 which, in turn, is coupled between one terminal of transistor 622 and ground. The opposite terminal of transistor 622 is coupled via line 626 and resistor R19 to line 582 of the corresponding solenoid drive channel PA0. Resistor R19 provides a current limiting function for deriving the noted lower level holding current. Accordingly, with the actuation of a first solenoid, an initial higher current is developed from transistor 578 which then is diminished following a predetermined opening interval and the holding current ensues via the operation of transistor 622 until the termination of excitation of the solenoid winding.

Terminal PA7 from RIOT 432 is seen to provide a counter-clockwise motor drive signal via line 630 which extends (FIG. 17C) to open collector inverter driver 632 having an output at line 634. Line 634, in turn, extends to the cathode of a diode D1 of an opto-coupler 636. Device 636 consists of a gallium arsenide infrared emitting diode coupled to a symmetrical bilateral silicon photodetector. The detector is electrically isolated from the input and performs as an isolated FET. Such devices, for example, may be provided as type H11F marketed by General Electric Corporation. Diode D1 is coupled by line 638 and resistor R20 to +5v, while the corresponding photoresponsive switching device 640 is coupled to +24v through a variable resistor or the like shown as a resistor R22 and wiper arm 642. The opposite terminal of the device 640 is coupled via line 644 to the input of an operational amplifier 646. Amplifier 646 is of a high voltage and current variety having self-contained thermal sensing and shut-off to prevent damage due to overheating. The devices may be provided, for example, as type 3571AM marketed by Burr-Brown, Inc. Returning to FIG. 17A, terminal PB7 of RIOT 432 is seen to provide a clockwise motor drive output at line 648 which, looking to FIG. 17C, extends to the input of inverter buffer/driver 650. The open collector output of device 650 extends via line 652 to light emitting diode D2 of opto-isolator 654. Provided as the same device as described at 636, diode D2 is seen coupled via line 656 and resistor R25 to +5v such that the diode D2 is illuminated on the application of a high logic signal at line 648. As in the case of device 636, photodiode D2, when energized, turns on a photo-activated switching device 658 having one terminal coupled via line 660 to a variable resistor or the like represented at R24 which, in turn, is coupled to −24v supply. The opposite terminal at device 658 is coupled via line 602 and resistor R26 to line 664. Line 664 is directed to an intersection 654 representing a summing point. Thus, either a negative supply is applied to line 644 in conjunction with clockwise commands from line 648 or, oppositely, a +24v supply may be asserted through resistor R23 to line 644 from the counter-clockwise command asserted from line 630.

A manual activation provision for the motor also is supplied from line 664 to the summing point. In this regard, a switch S4 is shown coupled to +24v supply via line 666 and through line 668 and resistor R27 to line 664. Thus, by actuating switch S4, +24v supply is applied to line 664 for presentation to line 644 at the input of amplifier 646. For clockwise motion of the motor, switch S5 is provided which is coupled via line 670 to −24v supply and to line 664 through resistor R28. Thus, when switch S5 is actuated, a clockwise directional −24v supply is asserted to line 644 and the amplifier 646.

Amplifier 646 is seen to provide an output line 672 and to incorporate a feedback path including lines 674 and 676 principally including resistor R29 coupled within line 678 between line 674 and 676. The second input to amplifier 646 is coupled to ground via line 680 and is filtered by capacitor C9. Additionally, the amplifier is seen to be coupled to +24v supply from line 682 which is filtered by capacitor C11. Line 684 couples the device to −24v supply as filtered by capacitor C10 and current protection is provided by a combination of resistor R30 within line 686, as well as by resistor R31 within line 688. Diodes D4 and D6 provide inductive spike protection. With such current limiting, the motor 124 will tend to simply stall after its limits are reached such that the pins of head 12 are not damaged, for example, if trapped in the surface being marked. The output at line 672 additionally is seen to be directed, depending upon the polarity thereof, through steering diodes D5 and D7.

It may be observed that the feedback path comprised of lines 674 and 676 extending about amplifier 646 further includes a series of three opto-coupler devices as represented at 690–692. At such time as any one of these devices is turned on such that their light emitting diodes are illuminated, the feedback path of amplifier 646 is, in effect, short circuit to assure that drive input to the motor 124 is cancelled. Thus, when opto-coupler 228 is normally turned on or conducting in the absence of flag 236, the output thereof at line 694, shown coupled through resistor R32 to +5v is low and is directed to the input of inverting buffer 696 to provide a corresponding logic high value at line 698. This functions to back-bias the photodiode D8 of device 690, the anode of which is coupled through resistor R33 to +5v. As a consequence, switching device 700, which is coupled via line 702 to line 676 and through steering diode D9 and line 704 to line 674 is in an off condition. However, as the flag 236 occludes interaction between the photodiode of opto-coupler 228 and its switching component, the logic value at line 694 reverts to a high value which is inverted at device 696 to permit the forward biasing of diode D8 and the turning on of photo-responsive switching component 700. As a result, the feedback path including lines 674 and 676 is short circuited. The logic status at line 698 is monitored by microprocessor 370 via the input therefrom derived from line 400 shown extending to terminal PC4 of RIOT 388 (FIG. 17A).

In similar fashion, opto-coupler 691 normally is off when the flag 236 does not occlude interaction of the opto-coupler 230. During this condition, the output of coupler 230 (FIG. 7) as provided to line 706 in FIG. 17C is at a logic low. Line 706 is shown coupled through pull-up resistor R34 to +5v. Line 706 extends to the input of inverter/buffer 708 having an open collector output at line 710. This logic condition functions to back-bias photodiode D10, the anode of which is coupled through resistor R35 to +5v supply. As a consequence the photo-responsive switching device 712 of opto-coupler 691 is turned off and has no affect upon the performance of amplifier 646. Device 712 is coupled to feedback line 676 via line 714 and through steering diode D11 within line 716 to feedback line 674. However, when the flag 236 occludes interaction between the photodiode and photoresponsive switching component of optical coupler 230, then the logic level at line 706 reverts to a high value and the output at line 710 reverts to a corresponding low to cause the illumination of photo-diode D10 and turning on of component 712 to short circuit the feedback path across amplifer 646 and negate any motor activity. The status of line 710 is monitored via earlier-described line 398 which, as shown in FIG. 17A, extends to terminal PC5 to RIOT 388.

Opto-coupler 692 is activated upon the condition of a low pressure for the air supply driving the stamping pins of head 12. Where such a signal is generated, a resultant transition occurs at line 718 from a logic high value to a logic low value which, in turn, effects the forward biasing of photodiode D12 of opto-coupler 692. The anode of diode D12 is coupled through resistor R36 to +5v supply and the diode functions to turn on photo-responsive switching component 720 to effect the noted short circuiting of the feedback path of amplifier 646. When diode D12 is not so illuminated, then device 720 is non-conducting and the feedback path is functional. Line 718 is monitored by earlier-described line 404 which extends as described in conjunction with FIG. 17A to the PC2 terminal input of RIOT 388. It may be observed that the opto-coupling devices 690–692 perform to negate motor activity in operational isolation from the microprocessor 370 generated control.

Figure 18:
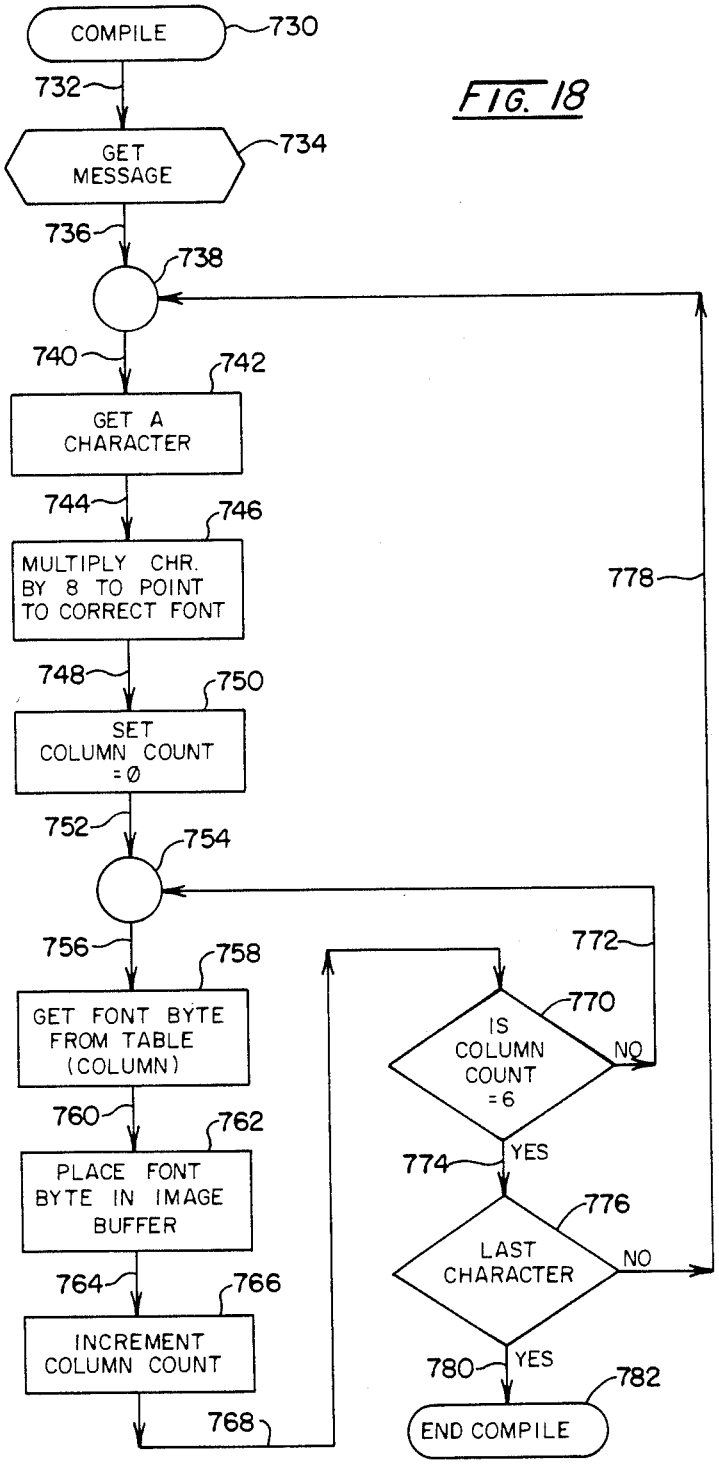
FIG. 18 is a flow diagram describing a compile routine employed in conjunction with the control developed with respect to FIGS. 17A–17C.

Referring to FIG. 18, a flow chart representing that portion of the control program of the apparatus 10 wherein a message is compiled for printing is provided. Additionally, reference is made to earlier-discussed FIG. 15 wherein a diagrammatic representation of the compilation routine at hand is provided. It may be recalled that a given message for printing will be received in serial data fashion from a personal computer, a host computer operating within an assembly line environment or by operator input keyed from the device 10 itself. Generally, a serial string of characters will be received followed by an ending signal such as a carriage return. The character matrix shown in FIG. 15, for the instant embodiment, will be provided for four pins, each pin moving in an away or home direction commencing at the top of the matrix then moving down whereupon the eighth bit derived in connection with the timing wheel is encountered and used as column shifting information. The compiling routine represented at FIG. 18 receives the message and accesses the font architecture from a look-up table with respect to each received character until such time as the fonts representing the message at hand are all positioned in readily accessible image buffer. Printing, however, will not ensue until a synchronization interrupt and pixel interrupt are developed from the timing wheel 284.

Looking to FIG. 18, the compiled routine is represented at label 730 leading as represented at line 732 to the procedures for collecting the message which is serially inputted to the device is represented at instruction 734. From this point the message is treated, as represented by a path including line 736, node 738 and line 740, a procedure commencing with the instruction at block 742 providing for obtaining a character from the message. When the character is identified, then as represented at line 744 and block 746, the identified character representation is multiplied by eight for the instant embodiment to provide or point at the appropriate address in memory for the font representing the character. Such a multiplication step provides flexibility for different numbers of stamping pins and the like. This factor 8, represents the number of pins at hand, i.e. four, multiplied by the number of characters to be printed by each such pin, i.e. two. The routine then progresses as represented at block 750 wherein the column counter is set to zero, whereupon it will be incremented for each byte or column until the six shown in the matrix of FIG. 54 are treated. The routine then progresses as represented at line 752, node 754 and line 756 to the instructions at block 758 wherien the font byte for the column at hand is obtained from the noted character or font look-up table. For the matrix shown in FIG. 15, the first column will show pixels at five locations for the character "A". The routine then continues as represented at line 760 to the instructions at block 762 wherein the font byte so obtained from memory is positioned in the image buffer and, as represented at line 764 and block 766, the column count then is incremented to the next column or byte position. The routine then progresses as shown at line 768 to the inquiry at block 770 wherein a determination as to whether the column count is equal to six is made. At such an occasion, the matrix for a single character will be completed. In the event that the count is not at the completion or sixth level, then as represented at loop line 772, the routine returns to node 754 a sufficient number of times to complete the character matrix. An affirmative result at the query of block 770 results, as represented at line 774 and block 776 in a determination as to whether the last character has been completed. In this regard, the last character will be the second for each pin. In the event that it has not, then as represented by loop line 778, the routine returns to node 738 to repeat the procedure obtaining a next character. In the event of an affirmative determination at block 776, then as represented at line 780 and as labelled at 782, the compile routine is concluded.

Figure 12:
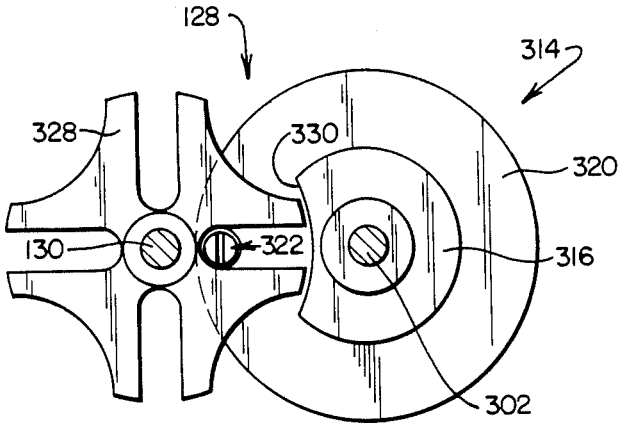
FIG. 12 is a partial sectional view of the apparatus of FIG. 5 taken through the plane 12—12 thereof.
Figures 19, 20:
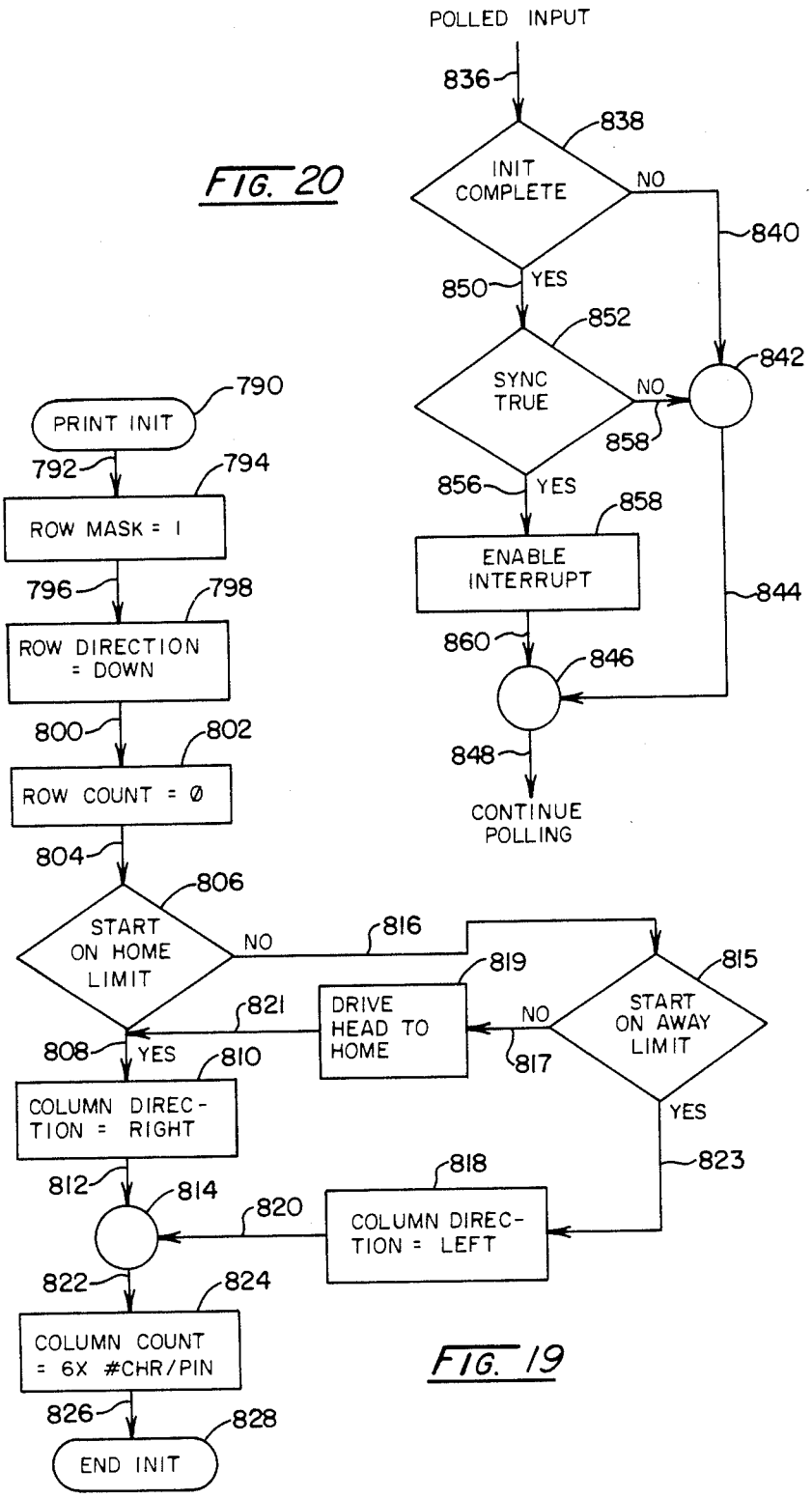
FIG. 19 is a flow diagram describing a print initiation routine employed in conjunction with the control features of the apparatus of the invention.
FIG. 20 is a flow diagram describing a polled input routine employed in conjunction with the control components of the apparatus of the invention.

Referring to FIG. 19, a print initiation routine is illustrated in flow chart fashion. This routine occurs in conjunction with a command effecting the commencement of a print-out. That command may occur, for example, by the operator actuating the button or switch 48 shown in FIG. 1 or the command can be effected to cause printing to commence immediately upon the conclusion of the character string, for example, in response to the noted carriage return signal. For the latter operation, such parameters are set by the earlier-described switch arrays S2 and S3 described in conjunction with FIG. 17A. The initiation routine is labelled at 790 and commences as represented at line 792 and block 794 to set the row mask equal to 1. The row mask then will mask everything with the exception of pixels within given rows. Following this procedure, as represented at line 796 and block 798, the row direction is set for down inasmuch under the instant protocol head 12 always starts at the top of the character in consonance with the location of the synchronization opening 354 timing disk 352 (FIG. 12). The routine then progresses as represented at line 800 and block 802 to set the row count at zero for the commencement of printing and the routine progresses as represented at line 804 to the inquiry at block 806. Here a determination is made as to whether the carriage 64 is at the home limit position or the away limit position. If the home limit position is present, then as represented at line 808 and block 810, the column direction as seen in FIG. 15 is set to the right such that the matrix is developed from the home position toward the away position. The routine then progresses as represented at line 812 to node 814. Where the inquiry at block 806 indicates that the home limit is not present, then as represented at line 816 and block 815 a determination is made as to whether the starting position is at the away limit. If it is not, as represented at line 817 and block 819, the head is driven to its home position and as represented at line 821, the program continues. Where the determination at block 815 is affirmative, then as represented at line 823 and block 818, the carriage 64 is assumed to be in the away limit location and the column direction is established to the left for progressing from the away location towards the home location. As represented at line 820, the routine then progresses to node 814 and line 822 wherein the column count for this initiation is set to six times the number of characters per pin which, as before, represents a programming aid for flexibility in adjusting to variations of head configurations. This information, for example, can be inserted from a control terminal. The initiation routine then progresses to end as represented at line 826 and label 828.

Upon completion of the print initiation routine as described in conjunction with FIG. 19 as well as the compilation operations described in conjunction with FIG. 18, the motor will have driven carriage 64 to an appropriate home or away limit and the program polls the system awaiting proper synchronization occasioned by the rotation of timing disk 352 and the detection of the synchronization opening 354 by opto-detector 356 (FIG. 12). Referring to FIG. 20 a polling routine is depicted which commences as represented at line 836 to a determination represented at block 838 as to whether the initiation procedure described in conjunction with FIG. 19 has been completed. In the event that it has not, then as represented by line 840, node 842, line 844, node 846 and line 848 polling continues as labelled. However, where the initiation routine is completed, then as represented at line 850 and block 852, a determination is made as to whether the synchronization pulse has been developed from the opto-detector 356. In the event that it has not, then as represented at line 858, node 842, line 844, node 846 and line 848, polling continues until such synchronizing pulse has been received. When receipt of the synchronization pulse is obtained, then as represented at line 856 and block 858, the interrupts of the program are enabled such that the pixel interrupt may be detected and responded to in terms of stamping pin actuation. The routine then exits as represented at line 860, node 846 and line 848.

Figure 21A:
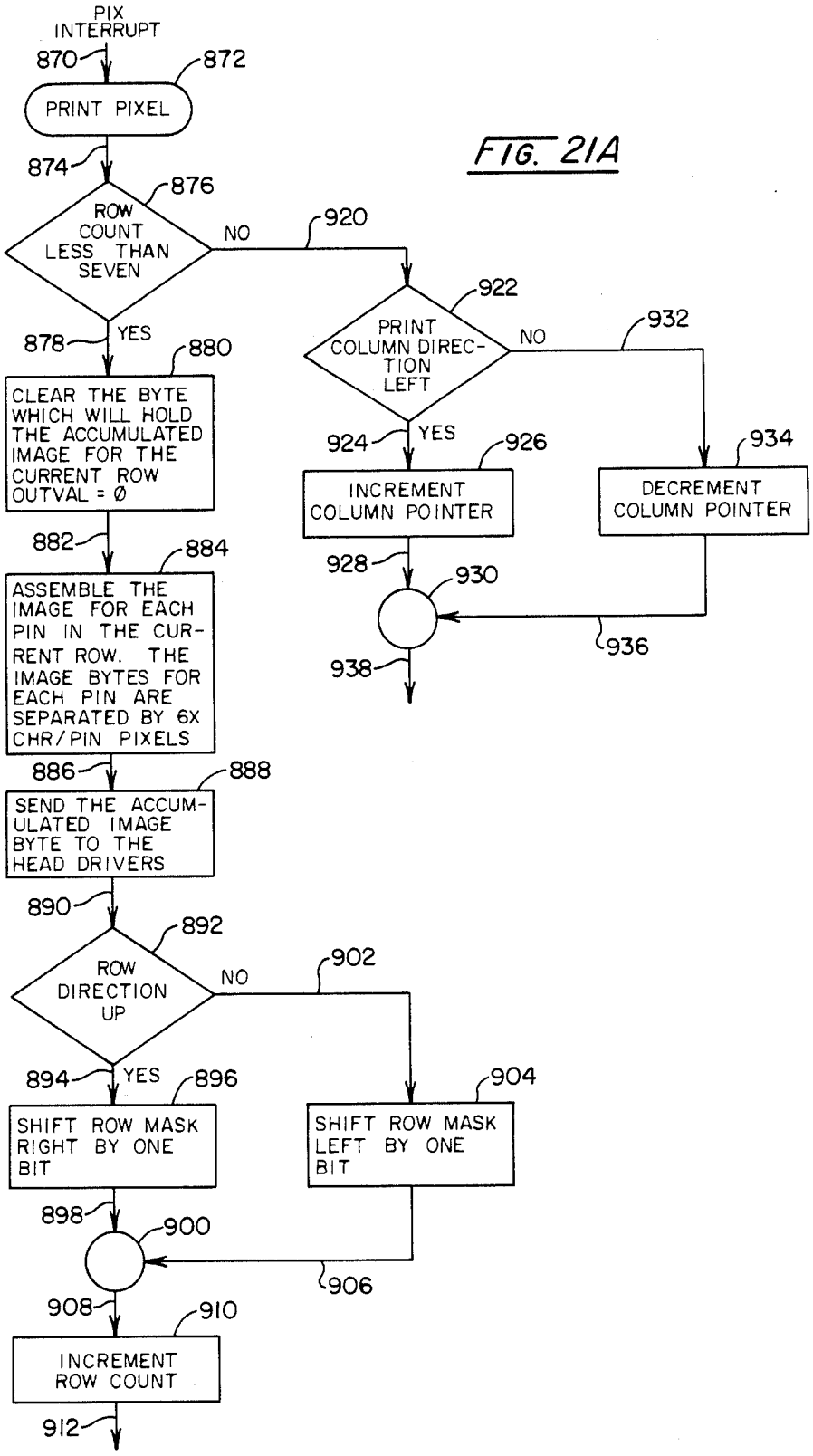
FIGS. 21A and 21B combine to provide a flow diagram describing a print interrupt routine employed with the control features of the apparatus of the invention.
Figure 21B:
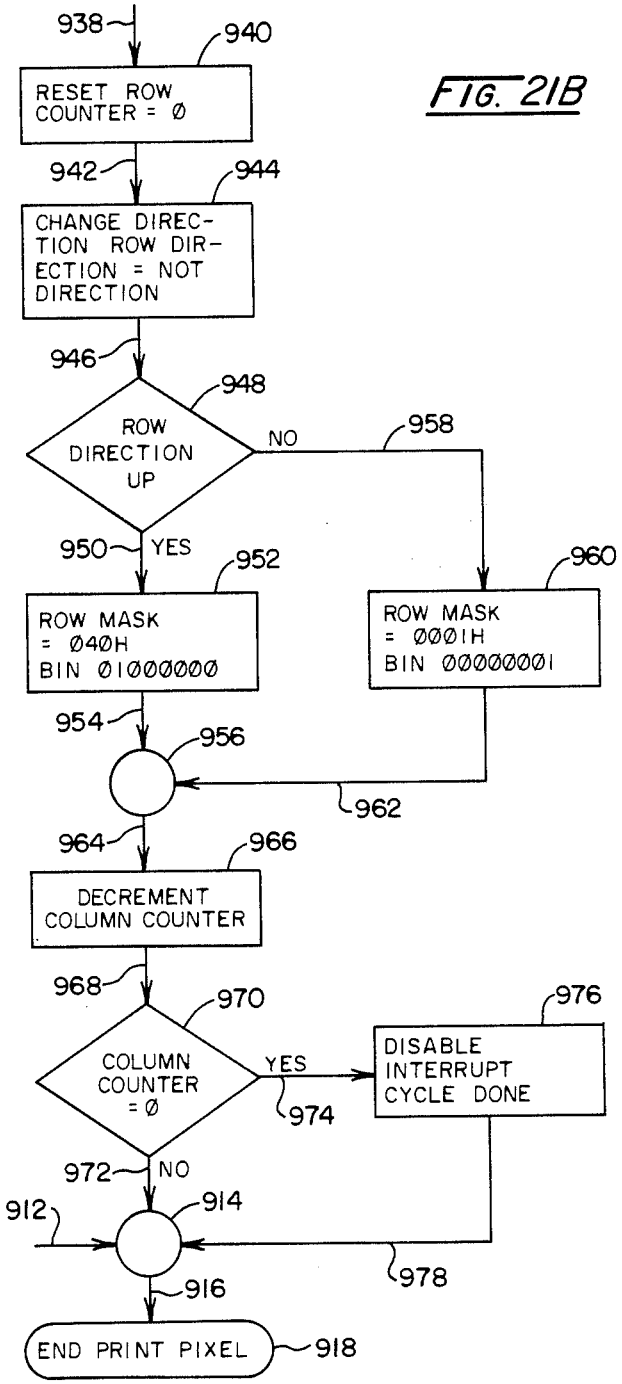

The control system of the instant apparatus is one responding to interrupt signals created by the movement of timing disk 284 and, in particular, the array of pixel signal creating openings 352 in that device. Thus, upon appropriate compilation initation and synchronization procedures, the program then looks to the creation of such an interrupt and carries out a pixel defining actuation of the stamping pins within head 12 in accordance with the several characters being formed. FIGS. 21A and 21B illustrate the program responding to these "pixel interrupt" signals.

Looking to FIG. 21A, the pixel interrupt presentation is represented at line 870 leading to the program label at 872 identified as "PIXEL." This program commences as at line 874 with the inquiry at block 876 determining whether or not the row count is less than 7. As discussed in conjunction with FIG. 15, it may be recalled that byte information is columnar, while row information defining a matrix will be 7 items in extent with an eighth row at the bottom of the pixels not being used. Thus, if a row count is less than 7 it is not 8 and, assuming an affirmative indication, as represented at line 878 and block 880, the byte (columnar) which would hold the accumulated image for the current row is cleared. Then, as represented at line 882 and block 884, the portion of the font or image corresponding with each stamping pin location for the current row is assembled. For purposes as discussed earlier of flexibility for software, the image bytes for each stamping pin are separated by six times the number of characters per pin assigned for the instant system. Then, as represented at line 886 and block 888, the accumulated image byte for the font at hand and in conjunction with the instant interrupt signal is sent to the head drivers, and particularly, the driver control arrangement with RIOT 432 (FIG. 17A).

Then, as represented at line 890 and block 892, an inquiry is made as to whether the row direction is up. It may be recalled in this regard that the mechanism driving head 12 is one creating an undulating or up and down movement and thus status of the head for the instant program is determined. Accordingly, where the row direction is determined to be up, then as represented at line 894 and block 896, the row mask is shifted to the right by one bit in anticipation of the next interrupt and the program proceeds as represented at line 898 to node 900. In the event the inquiry at block 892 is in the negative, then as represented at line 902 and block 904, the row mask is shifted to the left by one bit, a down direction of the head 12 being determined. The program then continues as represented at line 906 to node 900. From node 900 the program continues as represented at line 908 to block 910 wherein the row count is incremented. It may be recalled from the discussion in conjunction with FIG. 15 that 7 rows define the row portion of a character defining matrix, an eighth row being used for aiding in the implementation of the program. The program then continues as represented at line 912 to node 914 and line 916 wherein the print pixel program is ended in anticipation of a next pixel interrupt.

Returning to block 876, where the row count is not less than 7, then the eighth row level has been reached and, the program looks to movement to a next column as represented at line 920 extending to the inquiry at block 922 wherein a determination is made as to whether the column direction is to the left or right. At this juncture, the program determines whether the head 12 is moving in a direction from the home position toward the away position or vice versa. Where it is the prior, then as represented at line 924 and block 926, the column pointer is incremented accordingly and the program continues as represented at line 928 to node 930. On the other hand, where the query at block 922 shows movement toward from the home location, then as represented at line 932 and block 934, the column pointer is decremented and the program proceeds as represented by line 936 to node 930. The program continues as represented at line 938 extending to FIG. 21B to reset the row counter equal to zero as represented at block 940 and, as represented at line 942, information is provided as to the necessary change of row direction as represented at block 944. In the latter regard, it may be recalled that upon moving the column-position, the row position will change. The program then proceeds as represented at line 946 and block 948 to determine the row direction developed at block 944 and where that direction is determined to be up, then as represented at line 950 and block 952 the row mask equivalent to 40 hex is provided as represented in binary numbers in the block. The program then proceeds as represented at line 954 to node 956. Where the determination at block 948 is that the row direction is down, then as represented at line 958 and block 960, the row mask is made to 1 hex or the value shown in binary format in the block. The program then proceeds as represented at line 962 to node 956 and line 964 wherein, as represented at block 966, the column counter is decremented. Then, as represented at line 968 and block 970, a determination is made as to whether the column counter is equal to zero, representing the completion of character definition, for the instant embodiment of two characters for each pin. It may be recalled that the column counter valuation is that established at block 824 in FIG. 19. Where the column count is not at zero, then the control will await further inputs and, as represented at line 972, node 914, line 916 and label 918, the program exits to await a next interrupt. On the other hand, where the column count is zero, then as represented at line 974 and block 976, the print cycle is completed and the interrupts are disabled. The program then exits as represented at line 978 leading to node 914, line 916 and label 918.

As is apparent, the apparatus 10 can be implemented to perform in conjunction with a great number of industrial applications. For example, the device is readily oriented and applied against a workpiece by a robot. For other industrial applications, the X/Y pattern manipulation of the stamping pins may be employed with appropriate fixturing to a variety of character marking conditions. For example, a carrier bar or plate may be moved in this X/Y pattern which carries discrete stamping pins such that characters may be simultaneously marked at relatively widely separated locations and on different objects. The characters printed by each stamping assemblage of, for example, a singular pin can be independent in that the pin assemblages, although moved in a common "raster" pattern undulating up and down and from left to right or vice versa still are actuated independently within their character matrix by the controlling electronics as described above. Looking to FIG. 22, an arrangement 1000 shows single stamping pin assemblages as at 1002–1004 mounted upon a movable bar structure 1006 which, itself, is manipulated in an X/Y pattern as represented at 1008. The structure of the assemblage 1002, 1004 is relatively simple, representing a bracket as at 1002*a*, 1003*a*, and 1004*a* coupled to the bar 1006 by bolted connections 1002*b*, 1003*b*, and 1004*b*. The pin chambers are shown with an overhead solenoid valve as at 1002*c*, 1003*c*, and 1004*c*. Each of the assemblages then are manipulated in the locus of travel represented at 1002*d*, 1003*d* and 1004*d*.

Figure 22:
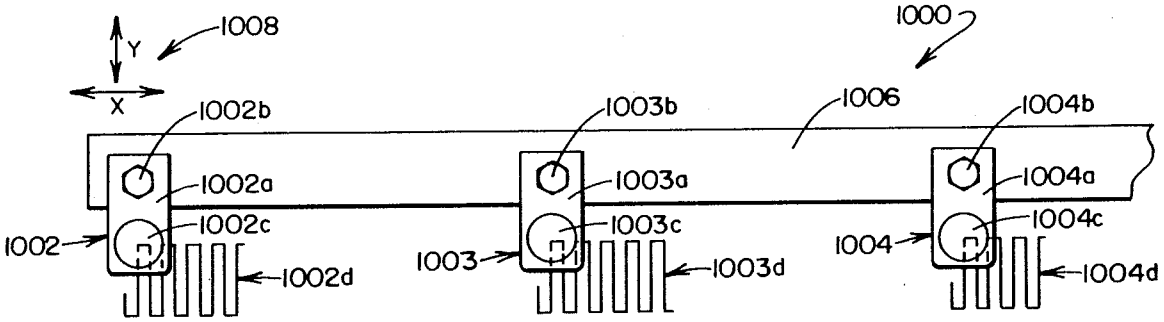
FIG. 22 is a top view of another embodiment of the instant invention.
Figure 23:
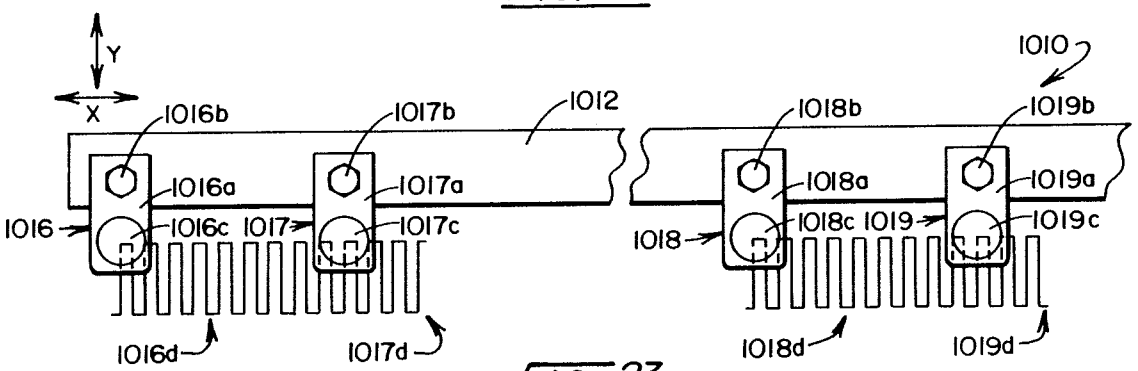
FIG. 23 is a top view representation of still another embodiment of the invention.

Looking to FIG. 23, the arrangement of FIG. 22 is expanded such that two stamping pin assemblages operate in mutual association for each marking site. In this regard, the assemblage 1010 is shown to include a common raster defining bar 1012 moving in the noted X/Y matrix defining pattern as represented at 1014. The stamping assemblages are spaced in paired groupings along the structure 1012 as at 1016–1017 and 1018–1019. As before, each of these structures 1016–1019 is formed, having brackets 1016*a*, 1017*a*, 1018*a*, and 1019*a* which are respectively retained upon the structure 1012 by bolted connections 1016*b*, 1017*b*, 1018*b*, and 1019*b*. Each such structure supports the solenoid valve control stamping chamber with associated pins as represented at 1016*c*, 1017*c*, 1018*c*, and 1019*c* to define loci of travel respectively represented and 1016*d*–1019*d*. Exemplary of applications for such devices would be marking of a row of pistons wherein the marking assemblages would be positioned along an articulating bar on centers which correspond to the piston fixture spacing. Gauge information can then be used to control the character dot matrix (gauge result) printed by each of the stamping pins on an associated piston.

Figure 24:
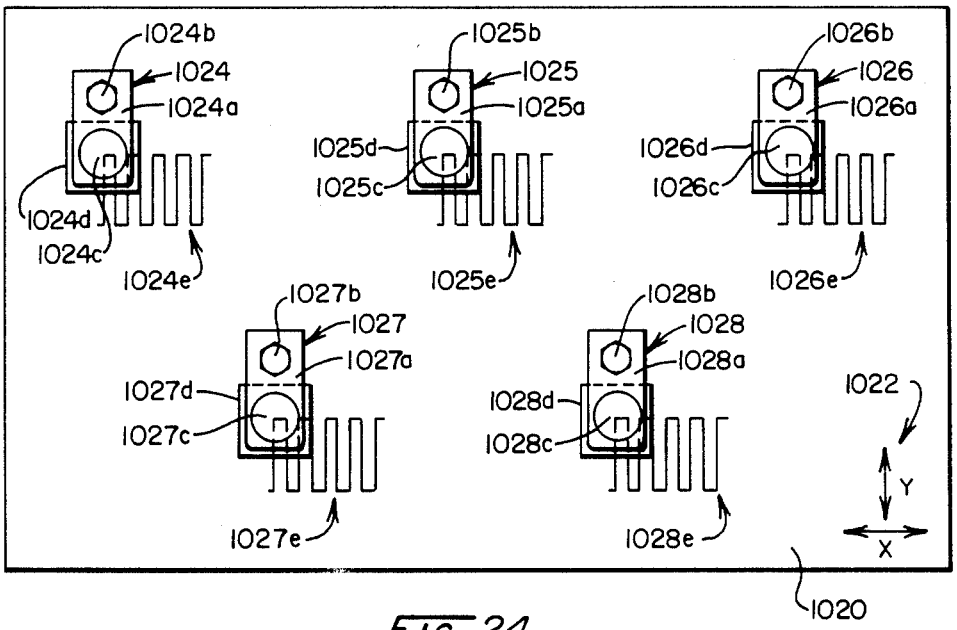
FIG. 24 is a top view of another embodiment of the instant invention.

The flexibility of the marking arrangement is represented in FIG. 24 wherein a number of marking devices can be positioned over a large X/Y plane area. In the figure, a plate 1020 which is movable in an X/Y locus as represented at 1022 is seen to carry five stamping assemblages 1024–1028. These devices are comprised, as before, of an appropriate bracket and housing 1024*a*–1028*a* which are secured to the plate 1020 by bolted connections 1024*b*–1028*b* and function to define the pin chambers and solenoid driven valve assemblages represented at 1024*c* which extend through openings in the plate 1020 as shown at 1024*d*–1028*d*. Each of the devices 1024–1028 then may trace an undulating locus of travel as represented respectively at 1024*e*–1028*e*.

Figure 25:
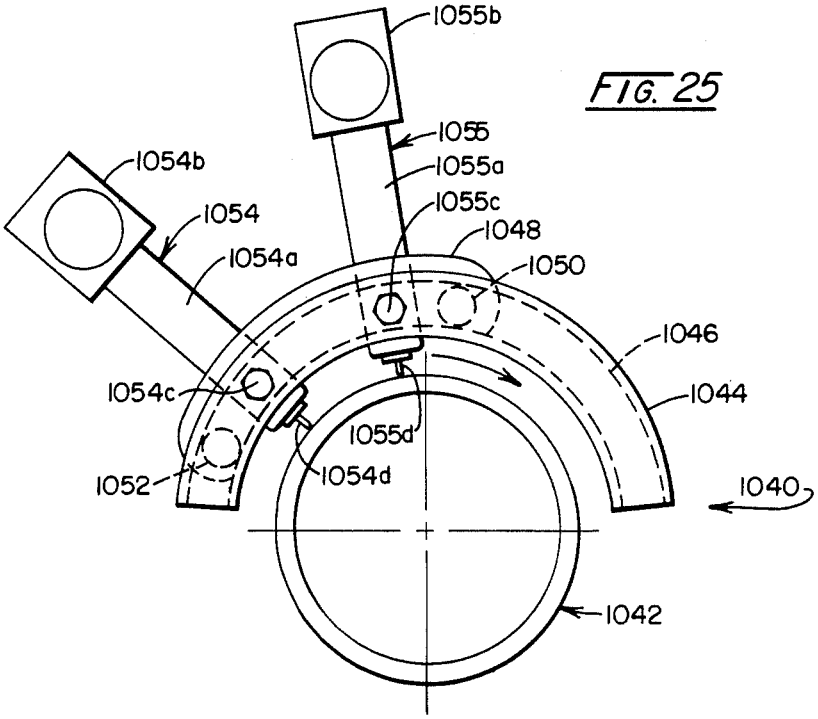

The fixturing flexibility of the arrangement is represented in FIG. 25 wherein characters are marked around a cylindrical object. In the figure, the arrangment 1040 shows a tube or the like 1042 about which an arcuate carriage guide 1044 having an internally disposed channel 1046 is provided. Within the channel 1046 a carriage 1048 is configured to ride as by rotatable supports 1050 and 1052 and which carries, for example, two stamping assemblies 1054 and 1055. These assemblages retain tubular pin and chamber structures 1054*a* and 1055*a* which are controlled from solenoid actuated valving retained within housing 1054*b* and 1055*b*. The devices are shown bolted to carriage 1048 as at 1054*c* and 1055*c* and are shown having pins 1054*d* and 1055*d* projectable therefrom.

Since certain changes may be made in the above-described system and apparatus without departing from the scope of the invention herein involved, it is intended that all matter contained in the description thereof or shown in the accompanying drawings shall be interpreted as illustrative and not in a limiting sense.

We claim:

1. Apparatus for marking objects at a surface thereof with dot-like indentations arranged within a predetermined character forming matrix of pixel locations in response to data inputs, said pixel locations being of predetermined number arranged within vertical columns, said columns being spaced apart in lateral increments of predetermined extent, comprising:

head means having a confronting portion movable between first and second terminal positions along a lateral locus of travel and movable between third and fourth vertical terminal portions substantially transversely with respect to said lateral locus of travel to effect a predetermined undulating locus of travel pattern, said head means having at least one chamber extending interiorly from said confronting portion and a marker pin mounted for reciprocation within said chamber, said marker pin having a drive portion and a shaft portion depending therefrom and extensible through an opening within said confronting portion, said shaft portion having an impacting tip driveably movable into said surface;

drive means for reciprocally driving said marker pin drive portion in response to control inputs;

motor means for providing a drive output;

first actuator means responsive to said motor means drive output for effecting intermittent movement of said confronting portion along said lateral locus of travel between said first and second terminal positions, wherein said confronting surface is horizontally shifted to sequential indexing positions representing said matrix vertical columns;

second actuator means responsive to said motor means drive output for effecting movement of said head means confronting portion between said vertical third and fourth terminal positions when said confronting portion is positioned by said first actuator means at a said indexing position and effecting a stationary dwell of said confronting portion at a said vertical terminal position during said horizontal shift movement thereof; and control means responsive to said predetermined locus of travel of said head means between said first and second and third and fourth terminal positions for deriving said control inputs to said drive means during said confronting portion movement between said vertical third and fourth terminal positions and only in correspondence with said pixel locations.

2. The apparatus of claim 1 in which:

said head means is mounted about a transverse axis for pivotal movement between said third and fourth terminal positions; and said second actuator means includes cam means coupled in driven relationship with said motor drive output, and lever means having a follower component in driven contact with said cam means and coupled in pivotal drive relationship with said head means.

3. The apparatus of claim 1 in which said control means includes timing means responsive to said drive output for deriving pixel signals corresponding to each said pixel location, and process control means responsive to said data inputs and to said pixel signals for deriving said control inputs to effect said character formation.

4. The apparatus of claim 3 in which said timing means comprises a timing member having a sequence of signal defining locations thereon, each corresponding with a said pixel location of said matrix, and detector means responsive to a said signal defining location for deriving a said pixel signal.

5. The apparatus of claim 4 in which said timing member is discoidal having first and second oppositely disposed disc surfaces and rotatable in response to said drive output, said signal defining locations are provided as a circular array of selectively spaced openings disposed inwardly from the circumference of said discoidal member, and said detector means comprises a light emitting component positioned at said first disc surface adjacent said array and a photo-responsive component positioned opposite said light emitting component adjacent said second disc surface.

6. The apparatus of claim 2 in which said head means contains at least two said chambers having a said marker pin within each thereof linearly aligned and mutually spaced apart a distance representing a whole factor greater than one integer times the width of said matrix, and said control means derives said control inputs for effecting the formation of more than one said character by each said marker pin.

7. The apparatus of claim 1 in which said first actuator means comprises intermittent drive mechanism means having a driver assembly coupled in driven relationship with said drive output and output component means responsive to said driver assembly for providing an intermittent output of predetermined extent when said head means is at said third and fourth positions, and translation mechanism means responsive to said intermittent output for effecting the movement of said head means along said lateral locus of travel a distance corresponding with the distance between adjacent said pixel locations of said matrix.

8. The apparatus of claim 7 in which said translation mechanism means comprises screw means having helical threads meshed with said head means and rotatably drivable to effect said movement between said first and second terminal positions.

9. The apparatus of claim 1 in which:

said first actuator means comprises intermittent drive means having a driver assembly coupled in driven relationship with said drive output and output component means responsive to said driver assembly for providing an intermittent output of predetermined extent when said head means is at said third and fourth positions and translation mechanism means responsive to said intermittent output for effecting the movement of said head means along said lateral locus of travel a distance corresponding with the distance between adjacent said pixel locations of said matrix;

said head means is mounted for pivotal movement about a transverse axis between said third and fourth terminal positions; and said second actuator means includes cam means coupled in driven relationship with said motor drive output, and lever means having a follower component in driven contact with said cam means and coupled in pivotal drive relationship with said head means.

10. The apparatus of claim 9 in which said cam means is configured having first and second dwell regions for effecting corresponding stationary dwells of said head means at respective said third and fourth terminal positions for intervals selected in correspondence with said first actuator means incrementing output of predetermined extent.

11. The apparatus of claim 9 in which:

said translation mechanism means comprises screw means providing said head means mounting for said pivotal movement having helical threads meshed with said head means and rotatably drivable to effect said movement between said first and second terminal positions; and said control means includes timing means responsive to said drive output for deriving pixel signals corresponding to each said pixel location, and process control means responsive to said data inputs and to said pixel signals for deriving said control inputs.

12. The apparatus of claim 11 in which said timing means comprises a timing member having a sequence of signal defining locations thereon, each corresponding with a said pixel location of said matrix, and detector means responsive to a said signal defining location for deriving a said pixel signal.

13. The apparatus of claim 12 in which said timing member is discoidal having first and second oppositely disposed disc surfaces and rotatable in response to said drive output, said signal defining locations are provided as a circular array of selectively spaced openings disposed inwardly from the circumference of said discoidal member, and said detector means comprises a light emitting component positioned at said first disc surface adjacent said array and a photo-responsive component positioned opposite said light emitting component at said second disc surface.

14. The apparatus of claim 13 which said timing member is mounted for co-rotation with said cam means.

15. Apparatus for marking solid material objects at a surface thereof in response to data inputs with a sequence of indentation defined characters, each within a pixel-defined matrix zone of given width, said matrix having predetermined pixel locations arranged within adjacent vertical columns, comprising:

carriage means movable with respect to said surface between first and second terminal positions along a laterally directed locus of travel and between third and fourth vertical terminal positions substantially transversely with respect to said laterally directed locus of travel to effect an undulating locus of travel pattern within a serial succession of said matrix zones;

first and second spaced marker pin assemblies mounted upon said carriage means, each having a respective first and second marker pin mounted for reciprocation within a chamber, each said first and second marker pin having a drive portion and a shaft portion depending therefrom and extensible through an opening in said chamber, said shaft portion having an impacting tip driveably movable into said surface within a said matrix zone said first and second marker pins being linearly aligned along said laterally directed locus of travel and being mutually spaced apart a distance representing a whole integer times said zone given width;

drive means for reciprocally driving each said marker pin drive portion in response to control inputs;

motor means for providing a drive output;

actuator means responsive to said motor means drive output for effecting intermittent movement of said carriage means along said lateral locus of travel between said first and second terminal positions wherein said first and second spaced marker pin assemblies are horizontally shifted to sequential indexing positions corresponding with respectively spaced said matrix vertical columns, and for effecting movement of said carriage means between said vertical third and fourth positions when said first and second spaced marker pin assemblies are positioned at said indexing positions and effecting a stationary dwell of said carriage means at a said vertical terminal position during said horizontal shift movement;

control means for deriving said drive means control inputs to effect simultaneous controlled character forming driving of said marker pin drive portions within spaced first and second ones of said zones corresponding with respective said first and second spaced marker pin assemblies, said control inputs effecting the sequential formation of more than one character by each said first and second marker pin assemblies.

16. The apparatus of claim 15 in which said control means includes timing means responsive to said drive output for deriving pixel signals corresponding to each said pixel location, and process control means responsive to said data inputs and to said pixel signals for deriving said control inputs to effect said character formation.

17. The apparatus of claim 16 in which said timing means comprises a timing member having a sequence of signal defining locations thereon, each corresponding with a said pixel location of said matrix, and detector means responsive to a said signal defining location for deriving a said pixel signal.

18. The apparatus of claim 15 in which:

said carriage means is mounted for slidable movement between said first and second terminal positions and for pivotal movement between said third and fourth terminal positions;

said actuator means includes a cam coupled in driven relationship with said drive output, lever means having a follower in driven relationship with said cam for effecting said carriage means pivotal movement, intermittent drive means for providing predetermined intermittent drive outputs, and translation mechanism means responsive to said intermittent drive outputs for effecting movement of said carriage means between said first and second terminal positions.

19. The apparatus of claim 16 in which said control means includes:

process control means responsive to said data inputs and to said pixel signals as interrupts for deriving said control inputs to effect formation of said sequence of characters.

20. The apparatus of claim 19 in which:

said timing means comprises:

a timing member having a sequence of pixel signal defining locations thereon, each corresponding with said pixel of said matrix, said timing member further including a synchronizing location thereon corresponding with a predetermined position of said carriage means;

detector means responsive to a said pixel signal defining location for deriving said pixel signals and responsive to said synchronizing location to derive a synchronizing signal; and said process control means is responsive to said synchronizing signal to initiate its said response to said pixel signals.

21. The apparatus of claim 20 in which:

said timing member is rotatable and discoidal having first and second oppositely disposed disc surfaces, said signal defining locations being provided as a circular array of selectively spaced openings disposed at a first radius of said discoidal member, and said synchronizing location being provided as an opening disposed at a second radius of said discoidal member; and said detector means comprises light emitting means positioned at said first disc surface for illuminating said openings, a first photo-responsive component positioned adjacent said second disc surface in operational alignment with said array, and a second photo-responsive component positioned adjacent said second disc surface in operational alignment with said opening disposed at said second radius.

22. Apparatus for marking solid material objects at a surface thereof in response to data inputs with a sequence of indentation defined characters, each within a pixel-defined matrix zone of given width, said matrix having predetermined pixel locations arranged within adjacent vertical columns, comprising:

carriage means movable with respect to said surface between first and second terminal positions along a laterally directed locus of travel and between third and fourth vertical terminal positions substantially transversely with respect to said laterally directed locus of travel to effect an undulating locus of travel pattern within a serial succession of said matrix zones;

first and second spaced marker pin assemblies mounted upon said carriage means, each having a respective first and second marker pin mounted for reciprocation within a chamber, each said first and second marker pin having a drive portion and a shaft portion depending therefrom and extensible through an opening in said chamber, said shaft portion having an impacting tip driveably movable into said surface within a said matrix zone, said first and second marker pins being linearly aligned along said laterally directed locus of travel and being mutually spaced apart a distance representing a whole integer times said zone given width;

drive means for reciprocally driving each said marker pin drive portion in response to control inputs;

motor means for providing a drive output;

first actuator means for moving said carriage means between said first and second terminal positions, including intermittent drive means having a driver assembly coupled in driven relationship with said motor means output and output component means responsive to said driver assembly for providing an intermittent output of predetermined extent when said carriage means is at said third and fourth positions and translation mechanism means responsive to said intermittent output for effecting the movement of said carriage means along said laterally directed locus of travel a distance corresponding with the distance between adjacent said vertical columns of said matrix;

second actuator means for moving said carriage means between said third and fourth terminal positions and including cam means coupled in driven relationship with said motor means drive output, and lever means having a follower component in driven contact with said cam means and coupled in pivotal drive relationship with said carriage means, said cam means being configured having first and second dwell regions for effecting corresponding stationary dwells of said carriage means at respective said third and fourth terminal positions for intervals selected in correspondence with said first actuator means incrementing output of predetermined extent; and control means for deriving said drive means control inputs to effect simultaneous controlled character forming driving of said marker pin drive portions within spaced first and second ones of said zones corresponding with respective said first and second spaced marker pin assemblies, said control inputs effecting the sequential formation of more than one character by each said first and second marker pin assemblies.

* * * * *